US006911609B2

(12) United States Patent
Miyauchi et al.

(10) Patent No.: US 6,911,609 B2
(45) Date of Patent: Jun. 28, 2005

(54) GRIP TYPE SWITCH DEVICE AND CONTROLLER FOR INDUSTRIAL MACHINERY USING THE SWITCH DEVICE

(75) Inventors: Kenji Miyauchi, Osaka (JP); Takao Fukui, Osaka (JP); Kazuya Okada, Osaka (JP); Yasushi Kamino, Osaka (JP); Ken Maeda, Osaka (JP); Yoshio Sekino, Osaka (JP)

(73) Assignee: Idec Izumi Corporation, Osaka (JP)

( * ) Notice: Subject to any disclaimer, the term of this patent is extended or adjusted under 35 U.S.C. 154(b) by 1 day.

(21) Appl. No.: 10/380,086

(22) PCT Filed: Sep. 12, 2001

(86) PCT No.: PCT/JP01/07926

§ 371 (c)(1),
(2), (4) Date: Mar. 11, 2003

(87) PCT Pub. No.: WO02/23567

PCT Pub. Date: Mar. 21, 2002

(65) Prior Publication Data

US 2004/0020756 A1 Feb. 5, 2004

(30) Foreign Application Priority Data

Sep. 18, 2000 (JP) ..... 2000-281946

(51) Int. Cl.[7] ..... H01H 9/28
(52) U.S. Cl. ..... 200/43.17; 200/321; 200/51 LM
(58) Field of Search ..... 200/43.17, 321, 200/329, 51 LM

(56) References Cited

U.S. PATENT DOCUMENTS 4,655,215 A * 4/1987 Pike ..... 606/42
5,195,164 A * 3/1993 Lambert ..... 392/385
5,383,875 A * 1/1995 Bays et al. ..... 606/1
5,428,197 A * 6/1995 McCurry et al. ..... 200/332.2
5,767,502 A * 6/1998 Ferland et al. ..... 235/462.48
6,051,894 A 4/2000 Shimogama
6,057,518 A * 5/2000 Bascom et al. ..... 200/43.17
6,288,352 B1 9/2001 Fukui et al.
6,335,500 B1 * 1/2002 Chi et al. ..... 200/341

FOREIGN PATENT DOCUMENTS

| | | |
|---|---|---|
| EP | 1014406 | 6/2000 |
| JP | 61-167330 | 10/1986 |
| JP | 63-11288 | 1/1988 |
| JP | 5-205554 | 8/1993 |
| JP | 5-268701 | 10/1993 |
| JP | 11-186751 | 7/1999 |
| WO | 98/49701 | 11/1998 |

* cited by examiner

*Primary Examiner*—K. Lee
(74) *Attorney, Agent, or Firm*—Jordan and Hamburg LLP

(57) ABSTRACT

A push-button switch 5 disposed in a switch case 3 has c-contacts and a normally close contact electrically connected with a terminal block 9 via conductors 39. Leading ends 23 of cores of a cable 7 introduced into the switch case 3 are inserted in insertion holes 49*a*, 49*b* formed in the terminal block 9. Screws 53*a*, 53*b* mounted to the terminal block 9 are tightened to press the leading ends 23 of the cores against conductive connection portions, on one side, in the insertion holes 49*a*, 49*b*, thereby to establish electrical connection.

12 Claims, 20 Drawing Sheets

GRIP TYPE SWITCH DEVICE AND CONTROLLER FOR INDUSTRIAL MACHINERY USING THE SWITCH DEVICE

TECHNICAL FIELD

The present invention relates to a grip type switch device including a switch case configured to be held by one hand and provided with a push-button switch adapted to be switched OFF or ON according to the amount of push-button depression, and to a controller for industrial machinery employing the grip type switch device.

BACKGROUND ART

In factories or the like, a controller for industrial machinery 201 provided with an industrial machinery, such as a robot, has an arrangement, as shown in FIG. 17, wherein a dangerous zone around the industrial machinery (the industrial robot) 203 is enclosed by a safety fence (partitioning means) 207 having a doorway 205 freely opened or closed whereby an operator is prevented from being involved in trouble that the operator is caught in the operating industrial machinery 203. In the case of normal operation of the industrial machinery 203, the operator standing outside the safety fence 207 controls the machinery 203 via a control panel 209 attached to an outside surface of the safety fence 207.

From the standpoint of safety, emergency stop switches 211 are provided at the control panel 209 and at plural places inside and outside of the safety fence 207. In the event of a dangerous state of the industrial machinery 203, any one of the emergency stop switches 211 inside and outside of the safety fence 207 may properly be manipulated to cut off power to a main circuit of the controller 201, thereby driving the whole controller 201 into emergency stop.

From the standpoint of safety, as well, a safety switch 215 is also provided at the doorway 205 of the safety fence 207 so as to deactivate the industrial machinery 203 when a door 213 in the doorway 205 is not fully closed.

The safety switch 215 is electrically connected with the industrial machinery 203 installed at place inside of the safety fence 207 and comprises, as shown in FIG. 18, a switch body 217 containing contacts, and an actuator 219 adapted to close or open the contacts in the switch body 217 when inserted into or extracted from the switch body 217. The switch body 217 is secured to the safety fence 207 at place around the doorway 205, whereas the actuator 219 is secured to the door 213. The actuator 219 is positioned at place corresponding to an insertion hole 221 of the switch body 217 so that the actuator may enter an operation section 223 of the switch body 217 when the door 213 is closed.

The inserted actuator 219 closes the contacts contained in a switch section 225 of the switch body 217, so that the industrial machinery 203 inside of the safety fence 207 is supplied with power and ready to operate. When, on the other hand, the actuator 219 is extracted from the operation section 223 by opening the door 213, the contacts in the switch section 225 are opened to cut off the power to the industrial machinery 203, so that the industrial machinery 203 does operate unless it is manually operated. Thus, the industrial machinery 203 does not operate when the door 213 is open. This leads to the prevention of the occurrence of trouble that the operator working inside of the safety fence 207 is caught in the operating industrial machinery 203.

In cases where the operator enters the zone inside of the safety fence 207 to manually operate the industrial machinery 203 or to carry out maintenance service for the industrial machinery 203, the operator uses a teaching pendant 227 equipped with a push-button switch, a so-called enable switch (deadman switch) in order to obviate an accident associated with contact with the operating industrial machinery 203 during the work.

As shown in FIG. 19, the teaching pendant 227 is a portable unit which is connected with the control panel 209 via a cable 229, thereby enabled to teach a program to the industrial machinery 203 or to operate the industrial machinery 203. The teaching pendant 227 includes an input keyboard 231 disposed on a main surface thereof, and a push-button switch (enable switch) 233 disposed on one side surface thereof. The push-button switch 233 is adapted to be switched from a first OFF state to an ON state, and then to a second OFF state according to the amounts of push-button depression. In some cases, the push-button switch 233 may be disposed on a back side of the teaching pendant 227.

When the teaching pendant 227 is in the first OFF state where a push button 235 of the push-button switch 233 is undepressed, key entry is not effected even though the keyboard 231 is manipulated. When the operator of the teaching pendant 227 teaches a program to the industrial machinery 203, the operator performs the key entry through the keyboard 231 while holding the push-button switch 233 in the ON state by depressing the push button 235. If, at this time, the operator releases the push button 235 recognizing potential danger of contact with any moving part of the manually operated industrial machinery 203, the push-button switch 233 is returned to the initial or first OFF state so that the industrial machinery 203 is deactivated.

In the event of an imminent danger panicking the operator into pressing further down on the push button 235, the push-button switch 233 in the ON state is shifted to the second OFF state, thereby deactivating the industrial machinery 203.

Thus, the teaching pendant 227 permits the key entry via the keyboard 231 thereof only when the push-button switch 233 thereof is in the ON state. Furthermore, the push-button switch 233 can be set to any of the three positions (the first OFF state, the ON state and the second OFF state) according to the amounts of push-button depression 235. Accordingly, the teaching pendant provides for a tangible indication of intent of the operator manually operating the machinery so that the safety of the operator is ensured.

In the manual operation of the industrial machinery 203 as described above, there may be a case where, in addition to the above operator, a plural number of assistant operators enter the zone inside of the safety fence 207 for assisting this main operator manipulating the teaching pendant 227. In this case, these assistant operators individually carry with them a grip type switch device for safety purpose when entering the zone inside of the safety fence 207, the grip type switch device equipped with a three-position type push-button switch of a similar configuration to that of the above push-button switch 233. That is, the industrial machinery 203 can also be deactivated by any of the assistant operators that shifts the grip type switch device to the second OFF state.

A specific example of the grip type switch device is shown in FIG. 20. As seen in the figure, the grip type switch device 239 includes a switch case 241 designed to be held by one hand, and a push-button switch 243 operable as depressed by the hand gripping the switch case 241. The switch device 239 is electrically connected with the aforesaid control panel 209 via a cable 245 connected with contacts in the switch case 241 by soldering and unified with the switch case 241.

The operators inside of the safety fence 207 perform their jobs with one hand thereof while gripping their grip type switch devices 239 in the other hand thereof, respectively. In a case where a program is taught to the industrial machinery 203, the program teaching to the industrial machinery 203 is not effected unless not only the push-button switch 233 of the teaching pendant 227 but also the push-button switches 243 of all the grip type switch devices 239 are shifted to the ON state. This ensures an even more enhanced safety during the work.

Another specific example of the grip type switch device is arranged such that an essential configuration and function of the switch device are substantially the same as those of the above grip type switch device and that a watertight connector is used for removably connecting the contacts in the switch case and the cable.

Since such grip type switch devices 239 are connected with the control panel 209 via the respective cables 245, the operators inside of the safety fence 207 usually carry out their jobs while trailing the cables 245 behind them. Therefore, the cable 245 may be damaged due to sliding contact with the floor or otherwise, a connection portion between the cable 245 and the switch case 241 may be so frequently twisted as to be broken.

Unfortunately, the specific example of the switch device shown in FIG. 20 has the configuration wherein the switch case 241 is unified with the cable 245. Therefore, even though only the cable 245 is damaged, it is impossible to replace the damaged cable alone. Hence, the whole grip type switch device 239 must be changed for the sake of cable replacement. This results in an extremely high maintenance cost.

In the other specific example of the switch device, the cable is connected with the contacts in the switch case via the watertight connector so that the cable alone can be replaced if it is damaged. However, the cable replacement also requires the watertight connector to be replaced. Since the watertight connector itself is quite expensive, a high maintenance cost results, as well.

When the operator performs his job inside the safety fence 207, the door 213 in the doorway 205 is held open whereby the contacts of the safety switch 215 are opened to cut off the power to the industrial machinery 203. However, there may be contemplated a case where the door 213 is inadvertently closed while the operator is working inside the safety fence 207. In such a case, a fear exists that the actuator 219 of the safety switch 215 enters the switch body 217 thereby inadvertently resuming the power supply to the industrial machinery 203.

In view of the foregoing, it is an object of the present invention to provide a grip type switch device wherein, in the case of damage to the cable, the damaged cable alone can be readily replaced at low cost.

It is another object of the present invention to ensure that the industrial machinery is positively maintained in cutoff even if the doorway of partitioning means, such as the safety fence, is inadvertently closed.

DISCLOSURE OF THE INVENTION

According to the present invention for achieving the above objects, a grip type switch device comprises a switch case configured to be held by one hand and including a push-button switch capable of being switched OFF or ON according to the amount of push-button depression, and is characterized in that connection means contained in the switch case establishes removable electrical connection between an end of a cable introduced into the switch case and contacts of the push-button switch.

According to this arrangement, the cable is removably held in electrical connection with the push-button switch by means of the connection means contained in the switch case. Hence, in the case of damage to the cable, for example, the damaged cable alone can be removed from the grip type switch device for replacement. In contrast to the conventional example where the damaged cable requires the replacement of the whole grip type switch device, the present invention does not require such a replacement nor require the provision of an expensive connector, such as a watertight connector. Thus, a maintenance cost associated with the cable replacement can be reduced.

In another aspect of the present invention, the grip type switch device is characterized in that the connection means comprises a base contained in the switch case, and a terminal block formed on the base and including a plurality of conductive connection portions, on one side, electrically connected with the contacts of the push-button switch, and that conductive connection portions, on the other side, attached to individual leading ends of plural cores of the cable are removably fitted with the corresponding conductive connection portions on the one side, thereby establishing electrical connection of the cable.

According to the arrangement, the conductive connection portions, on the one side, of the terminal block electrically connected with the push-button switch are removably fitted with the conductive connection portions, on the other side, attached to the leading ends of the cores of the cable. In order to replace the cable, therefore, the cores of the cable only need be disengaged from the terminal block, so that the cable replacement is facilitated. In addition, the push-button switch and the cable are interconnected by way of the less costly terminal block which contributes to a simple configuration. Thus, the maintenance cost for the grip type switch device can be reduced.

In another aspect of the present invention, the grip type switch device is characterized in that the connection means comprises a connector including a connector portion for the switch which is contained in the switch case and electrically connected with the contacts of the push-button switch, and a connector portion for the cable which is electrically connected with leading ends of plural cores of the cable introduced into the switch case and is removably fitted with the connector portion for the switch.

According to the arrangement, the connector portion for the switch in electrical connection with the push-button switch is removably fitted with the connector portion for the cable in connection with the leading ends of the cores of the cable. In order to replace the cable, therefore, the fitted connector portions only need be disengaged from each other, so that the cable replacement is facilitated. In addition, the push-button switch and the cable are interconnected by way of the less costly connector, which contributes to the simple configuration. Thus, the maintenance cost for the grip type switch device can be reduced.

In another aspect of the present invention, the grip type switch device is characterized in that the push-button switch is shifted from a first OFF state to an ON state and then to a second OFF state according to the increased amounts of push-button depression, and that the push-button switch includes an auxiliary contact in the switch case, the auxiliary contact designed to be opened or closed when the push-button switch is in the first OFF state and to be closed or opened when the push-button switch is in the second OFF state.

According to the arrangement, the push-button switch of the grip type switch device is adapted to be shifted from the first OFF state to the ON state and then to the second OFF state with increase in the amount of push-button depression. Hence, the push-button switch in the ON state can be returned to the first OFF state by releasing the pressure thereon, or otherwise be shifted to the second OFF state by further depressing the push-button switch. Thus is ensured the safety of the operator.

In addition, the auxiliary contact assuming different open/close positions in the first OFF state and the second OFF state is disposed in the switch case. Therefore, whether the push-button switch is in the first OFF state or in the second OFF state can be determined by monitoring the open/close position of the auxiliary contact.

In another aspect of the present invention, the grip type switch device is characterized in that the switch case is provided with an emergency stop switch to be manipulated for bringing an external system into emergency stop.

According to the arrangement, the emergency stop switch is provided at the switch case. Therefore, in the case of a dangerous situation involving the operator, the operator can bring the external system into emergency stop by manipulating the grip type switch device rather than directly manipulating the external system. This provides for a quick reaction to the emergency situation, leading to an enhanced safety during the work.

In another aspect of the present invention, the grip type switch device is characterized in that the switch case is provided with an actuator removably inserted in a safety switch provided at the external system, and that the external system is shifted to an enable mode for control via a control panel of the external system upon insertion of the actuator in the safety switch, whereas the external system is shifted to a disable mode for control via the control panel thereof upon extraction of the actuator from the safety switch.

According to the arrangement, the external system is disabled for control by extracting the actuator provided at the grip type switch device from the safety switch. Therefore, the external system can be disabled to control the machinery when, for example, the machinery is subjected to the teaching operation via the manipulated grip type switch device. This obviates an accident wherein the machinery is externally operated by mistake during the execution of the teaching operation. Thus, the safety during the work can be enhanced.

In another aspect of the present invention, the grip type switch device is characterized in that the actuator is disposed in the switch case in a manner to be freely projected or retracted.

According to the arrangement, in a case where the actuator is extracted from the safety switch before the teaching operation to the machinery is carried out, for example, the projected actuator can be retracted into the switch case. Therefore, the operator may retract the actuator projected from the switch case thereinto before the operator carries out his job as holding the grip type switch device in his hand, whereby the actuator is prevented from contacting the machinery or the like.

In another aspect of the present invention, the grip type switch device is characterized in that a guard member for partially covering a push button of the push-button switch is removably fixed to the switch case.

According to the arrangement, the guard member partially covers the push button so as to interfere with winding an adhesive tape about the push-button switch for holding the push-button switch in the ON state, for example. The guard member is effective to prevent a wrong use of the push-button switch that the push-button switch is held ON by winding the adhesive tape thereabout rather than by gripping the switch device by hand.

In another aspect of the present invention, the grip type switch device is characterized in that indication means indicative of the ON and OFF states of the push-button switch is provided at the switch case.

According to the arrangement, the indication means is provided for indication of the ON and OFF states of the push-button switch. Therefore, the operator of the grip type switch device can recognize the state of the push-button switch at a glance.

In another aspect of the present invention, the grip type switch device is characterized in that a drive switch for another device is provided at the switch case.

According to the arrangement, the drive switch for another device is provided at the switch case and hence, the another device can be operated by manipulating the drive switch at the grip type switch device. Therefore, the grip type switch device may also be used as operation means for another device, contributing to the increased efficiency of the work.

In another aspect of the present invention, the grip type switch device is characterized in that the switch case is provided with watertight means at a lead-in portion thereof, through which the cable is introduced into the switch case.

According to the arrangement, the switch case is provided with the watertight means at its lead-in portion for the cable and hence, the grip type switch device is prevented from suffering failure caused by water invasion. This ensures a trouble-free use of the grip type switch device even in an environment requiring a watertight measure.

In another aspect of the present invention, the grip type switch device is characterized in that a push button of the push-button switch projects from a periphery of the switch case, and that the switch case is formed with projections at places on opposite sides of the push button, the projections projecting further outward than the push button.

According to the arrangement, the projections projecting further outward than the push button are formed on the opposite sides of the push button, so that the push button is guarded by the projections sandwiching the push button therebetween. Thus, the projections prevent the push-button switch from being inadvertently depressed ON in cases where, for example, the grip type switch device is placed on a flat plane.

According to the present invention, a controller for industrial machinery comprises: partitioning means partitioning a zone around an industrial machinery and including a doorway freely opened or closed; and a control panel for the industrial machinery disposed near the doorway and switched between a disable mode for control and an enable mode for control in association with the ON state and the OFF state of the push-button switch of the grip type switch device, respectively.

According to the arrangement, the control panel for the industrial machinery is disabled for control when the push-button switch of the grip type switch device is ON. Therefore, the industrial machinery is prevented from being inadvertently activated by someone outside the partitioning means who manipulates the control panel when the program teaching to the industrial machinery is carried out by manipulating the grip type switch device. Thus, the safety of the operator can be ensured during the teaching operation.

BEST MODE FOR CARRYING-OUT THE INVENTION (First Embodiment)

Figure 1:
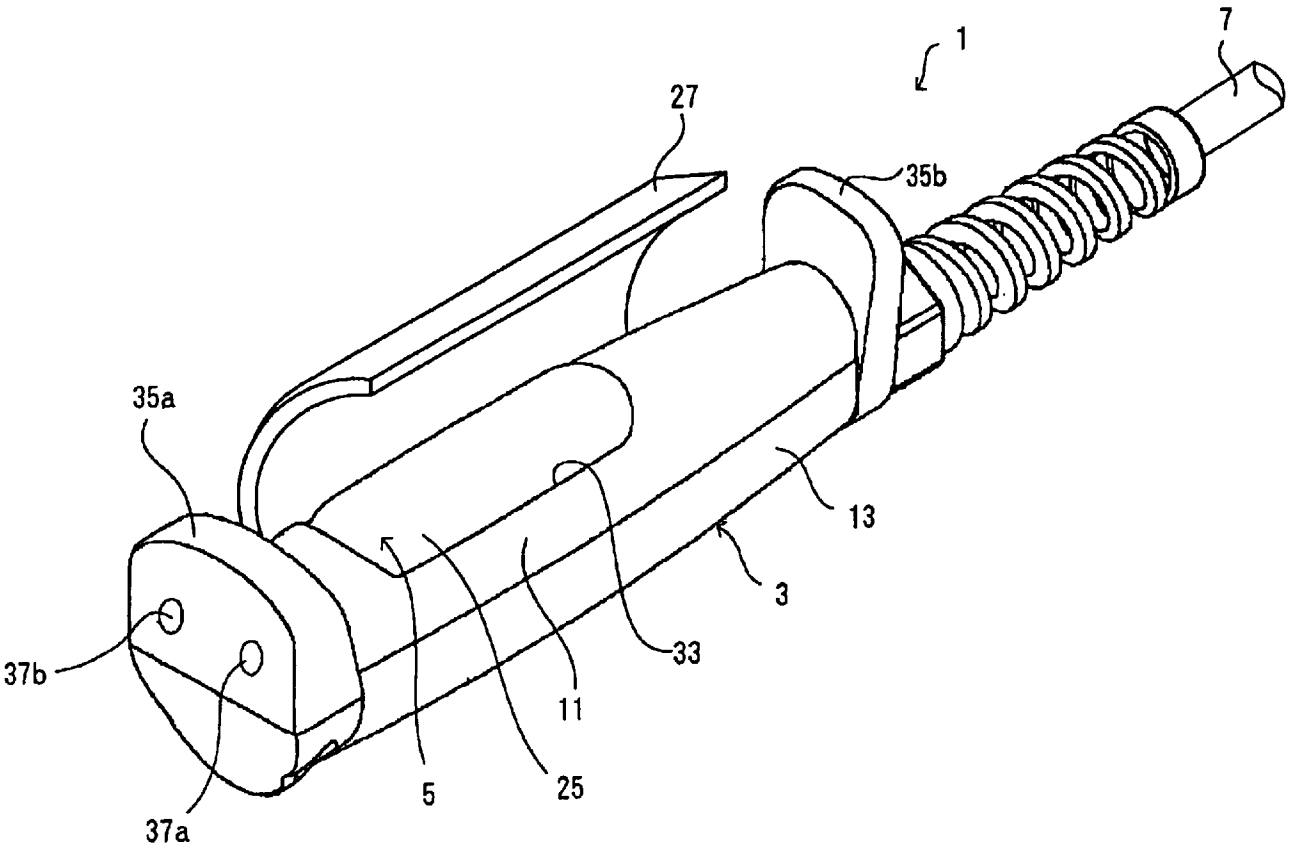
FIG. 1 is a perspective view showing a first embodiment of the present invention.
Figure 2:
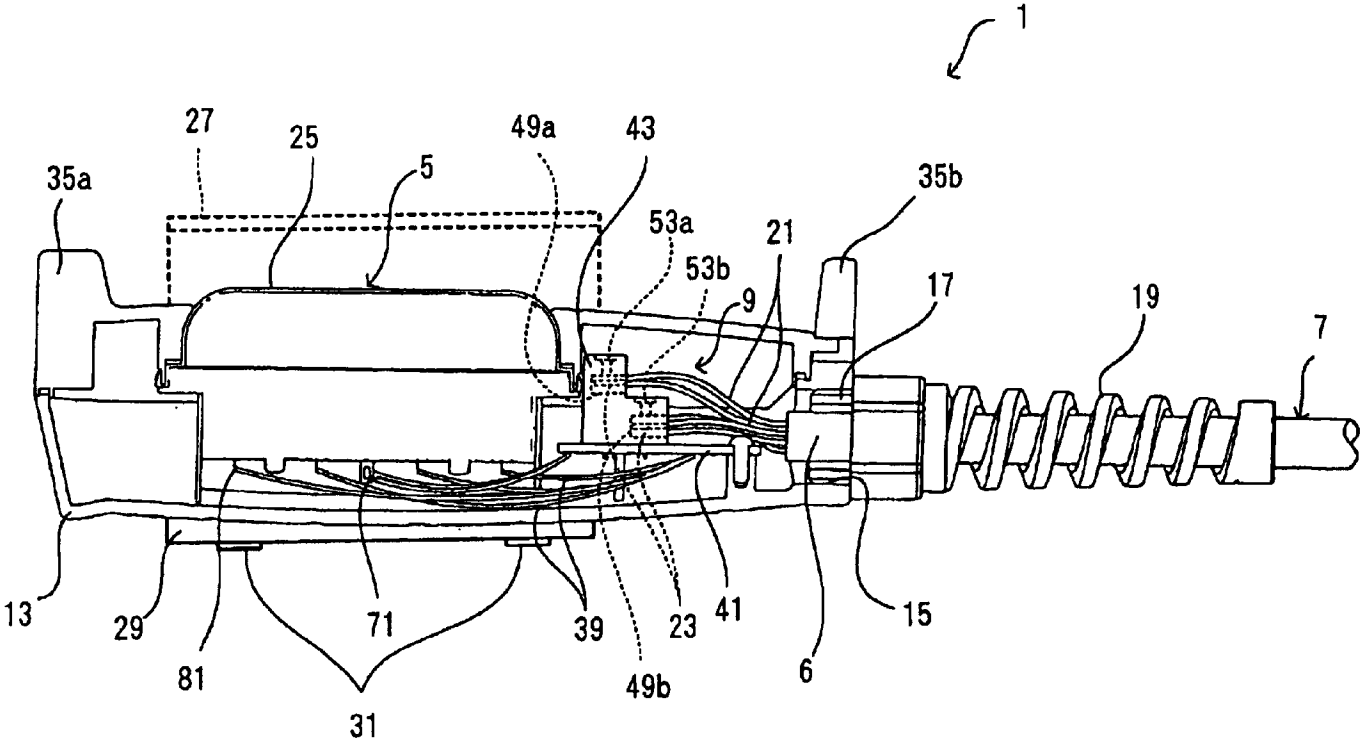
FIG. 2 is a side elevation in section showing the first embodiment hereof.
Figure 3B:
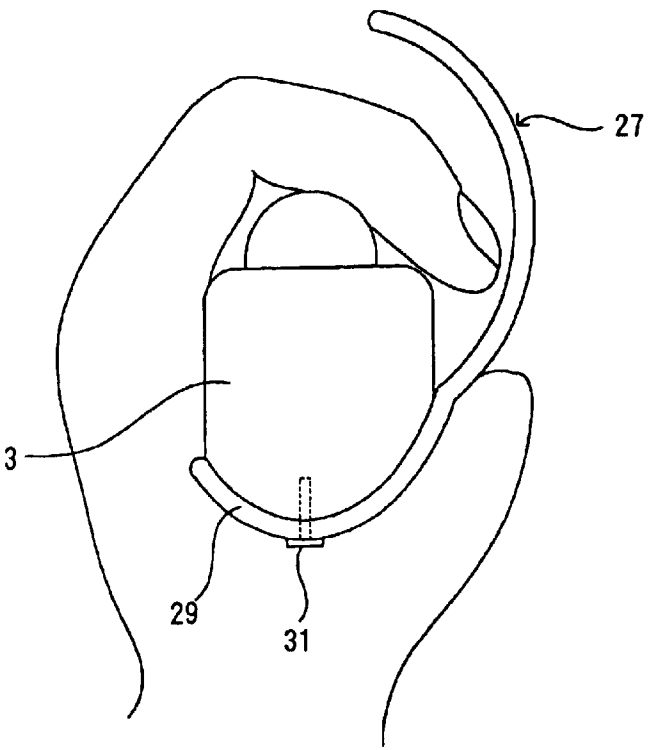
FIG. 3 is a group of diagrams explaining operations of the first embodiment hereof.
Figure 3A:
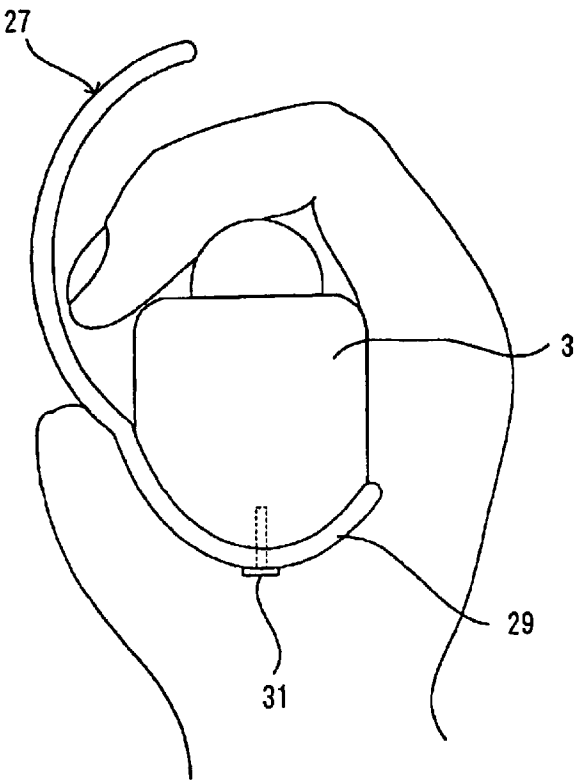
Figure 4:
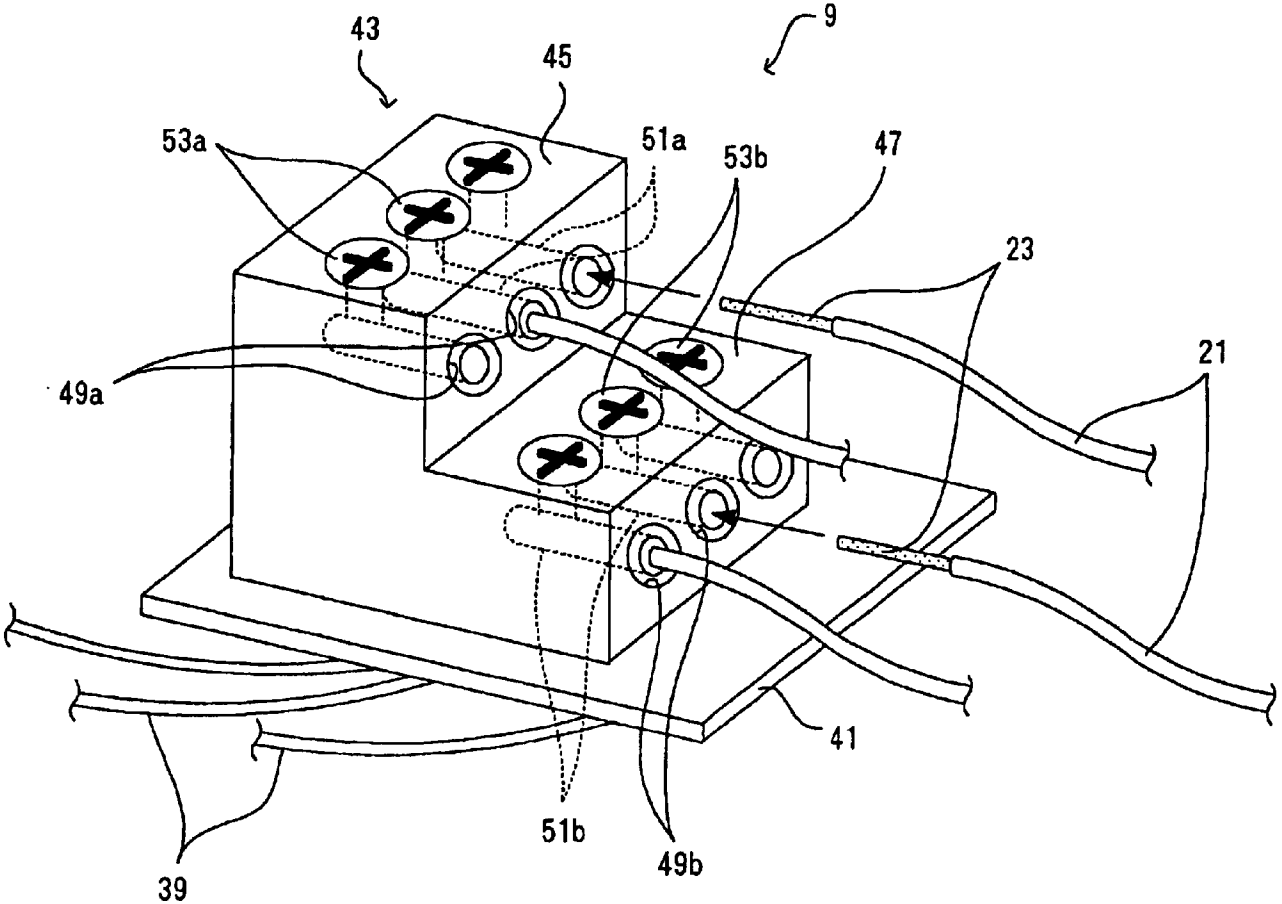
FIG. 4 is a fragmentary perspective view showing a part of the first embodiment hereof.
Figure 5:
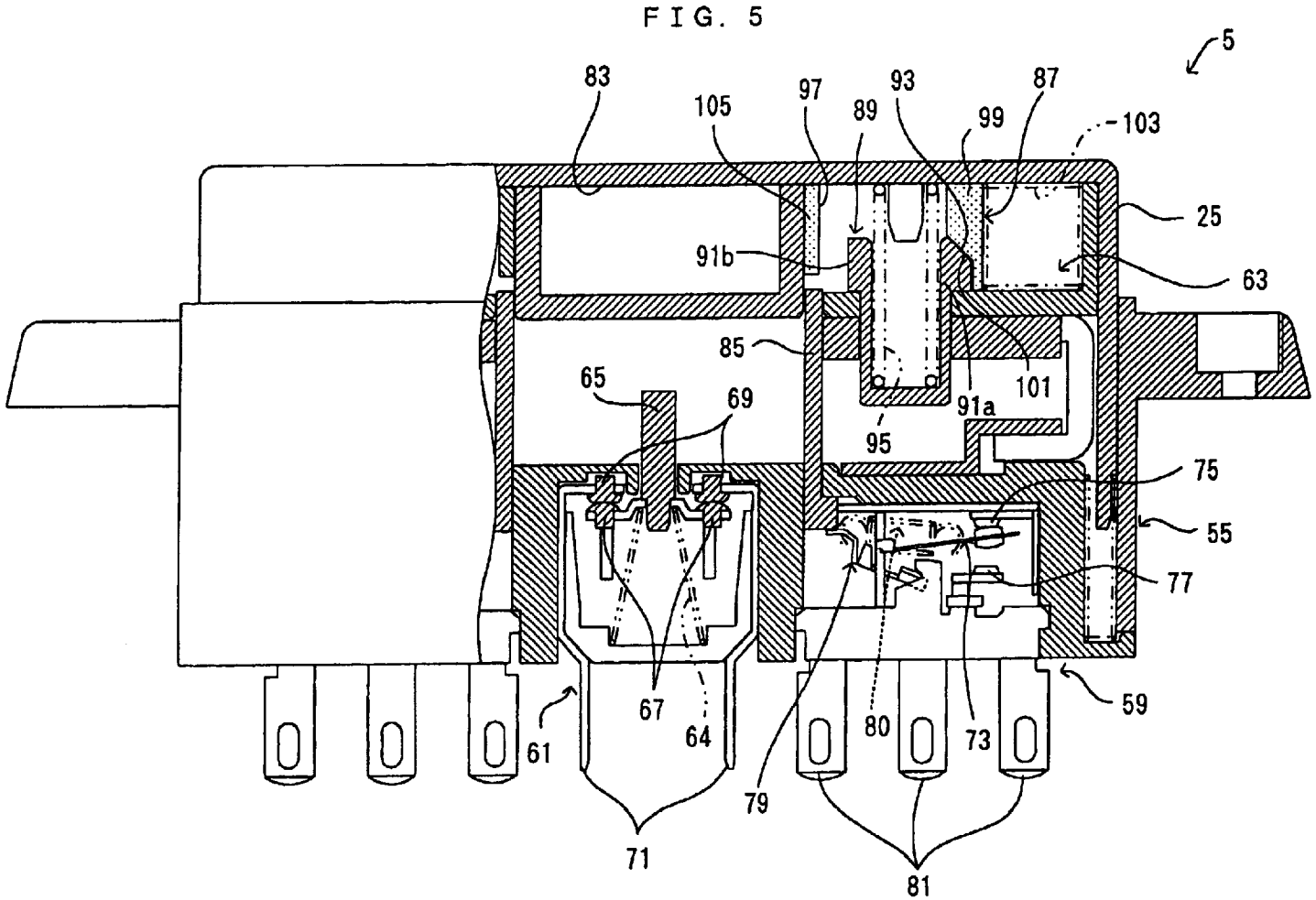
FIG. 5 is a sectional view showing one state of another part of the first embodiment hereof.
Figure 6:
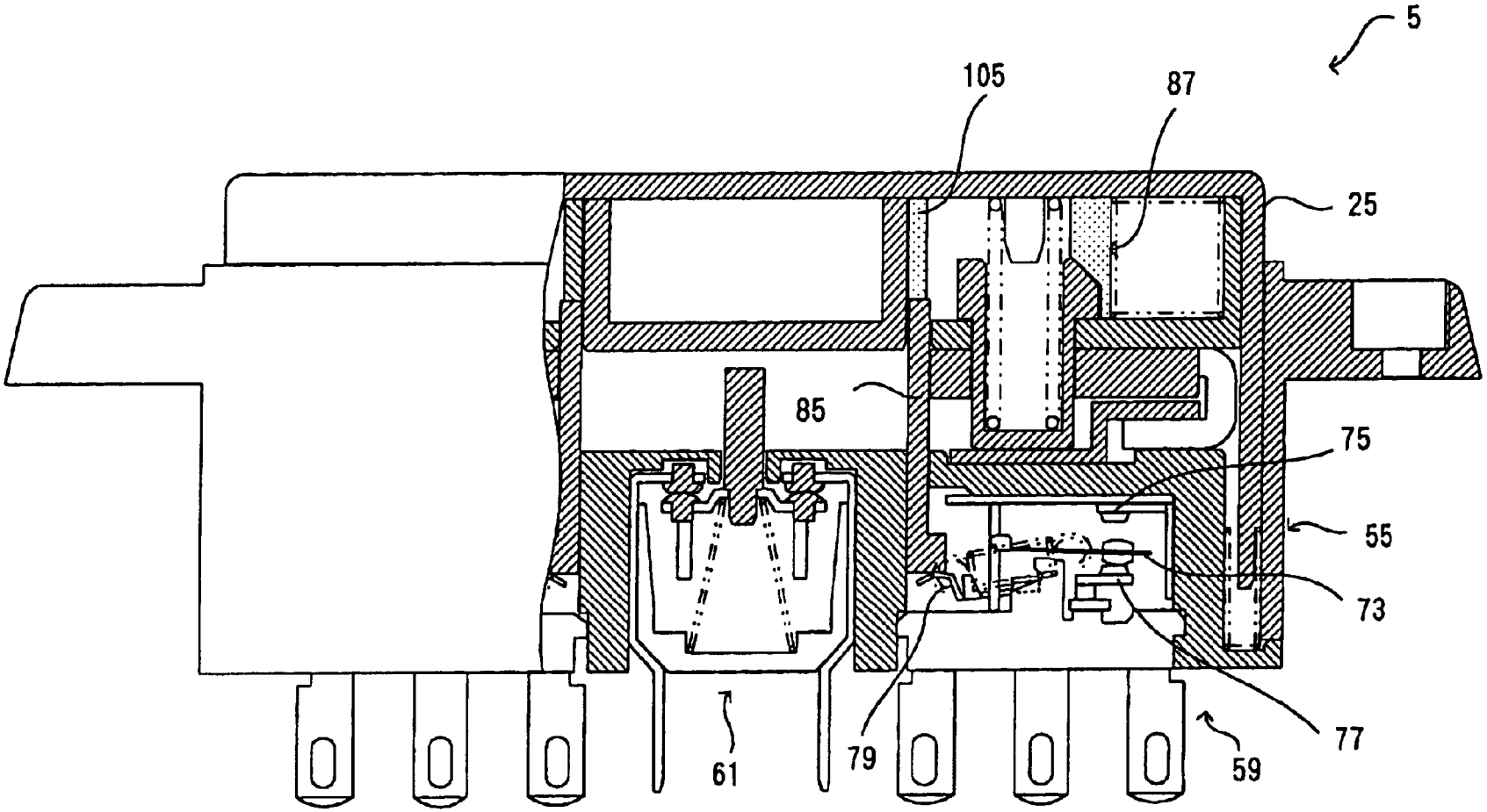
FIG. 6 is a sectional view showing another state of the above part of the first embodiment hereof.
Figure 7:
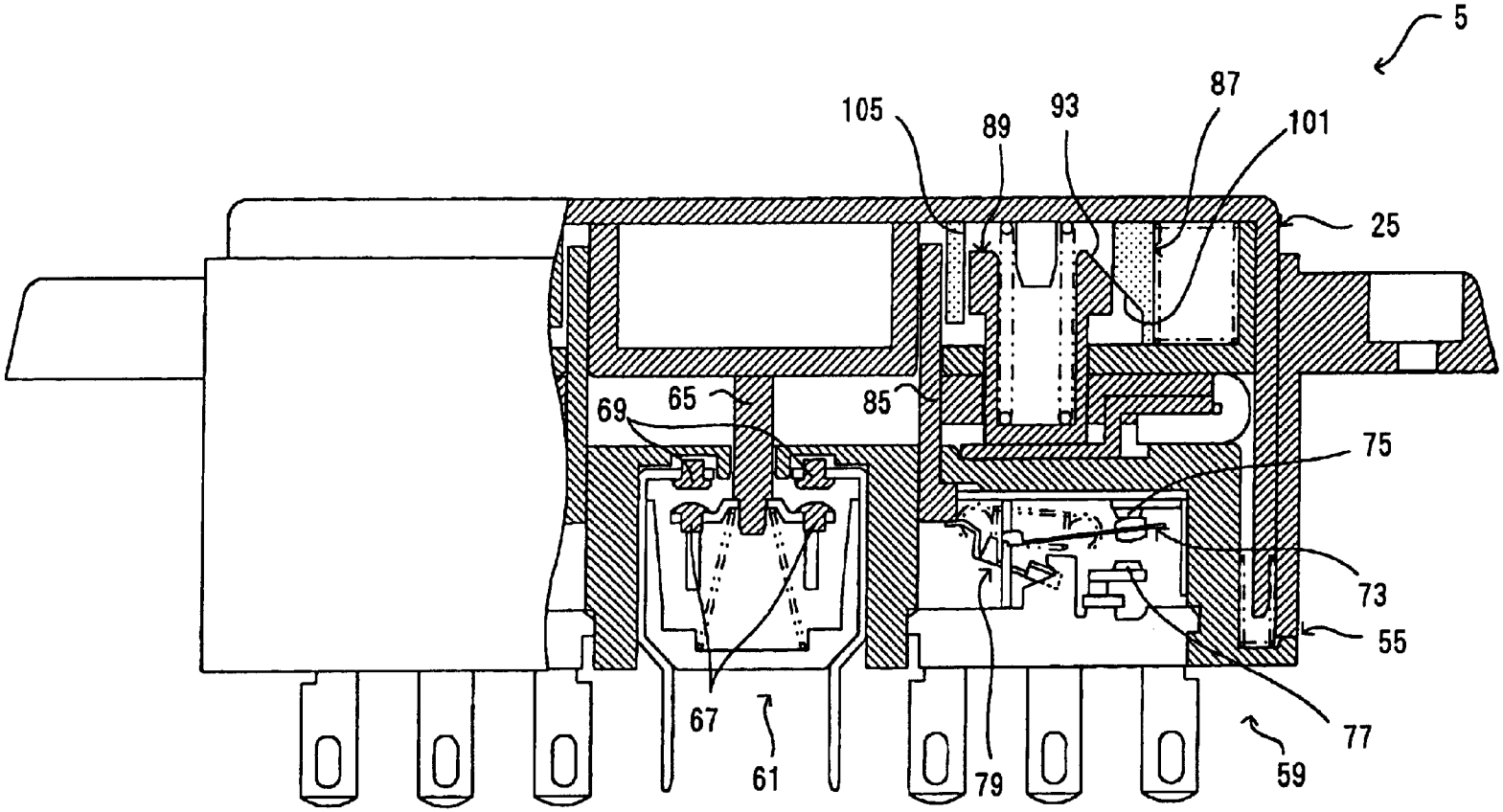
FIG. 7 is a sectional view showing still another state of the above part of the first embodiment hereof.

Now referring to FIGS. 1 to 7, the present invention will be described by way of a first embodiment thereof wherein the present invention is applied to a grip type switch device for use with a controller for industrial machinery such as an industrial robot. FIGS. 1 and 2 are a perspective view and a side elevation in section. FIG. 3 is a group of diagrams illustrative of how the grip type switch device is gripped. FIG. 4 is a perspective view showing a terminal block disposed in a switch case, whereas FIGS. 5 to 7 are sectional views each showing a different state of a push-button switch disposed in the switch case.

Figure 17:
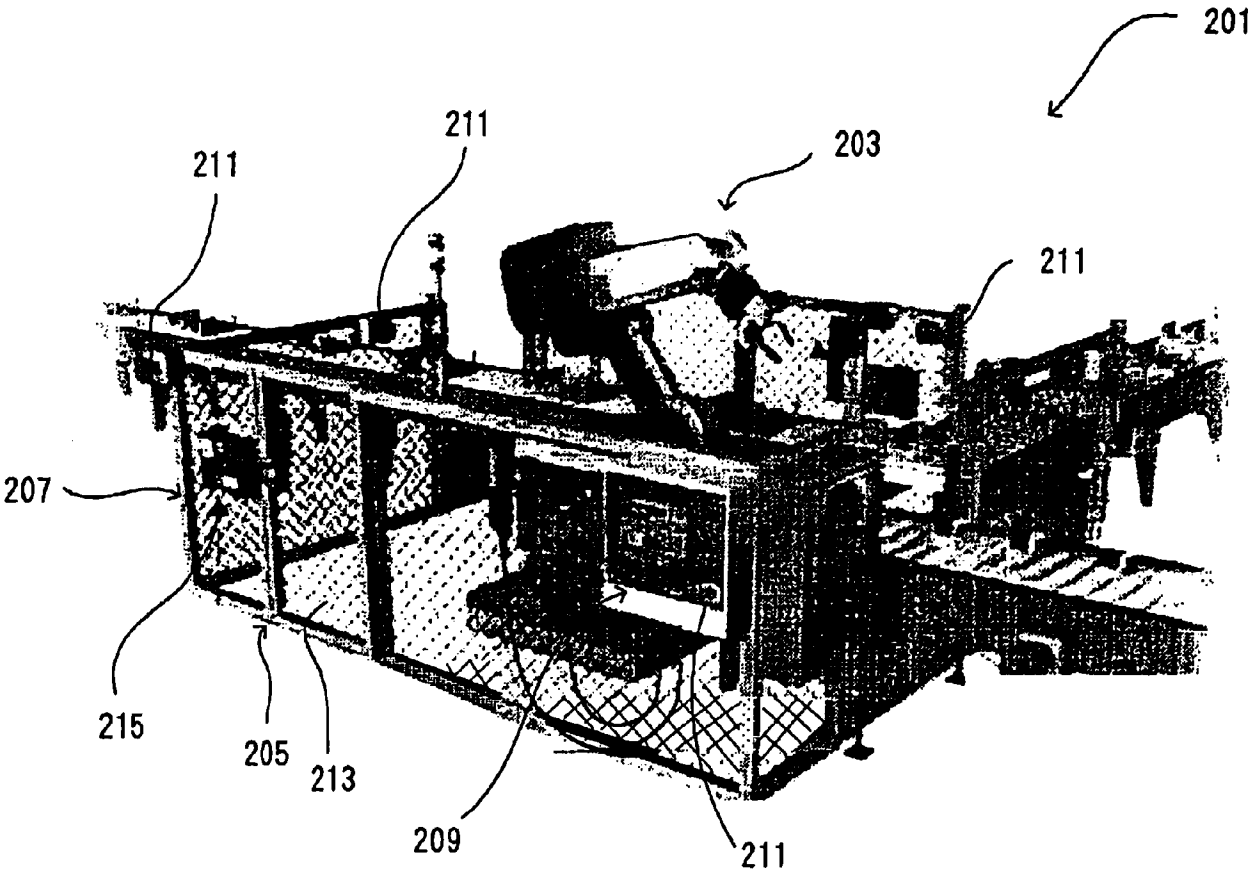
FIG. 17 is a perspective view showing a controller for industrial machinery according to the background art of the present invention.
Figure 18:
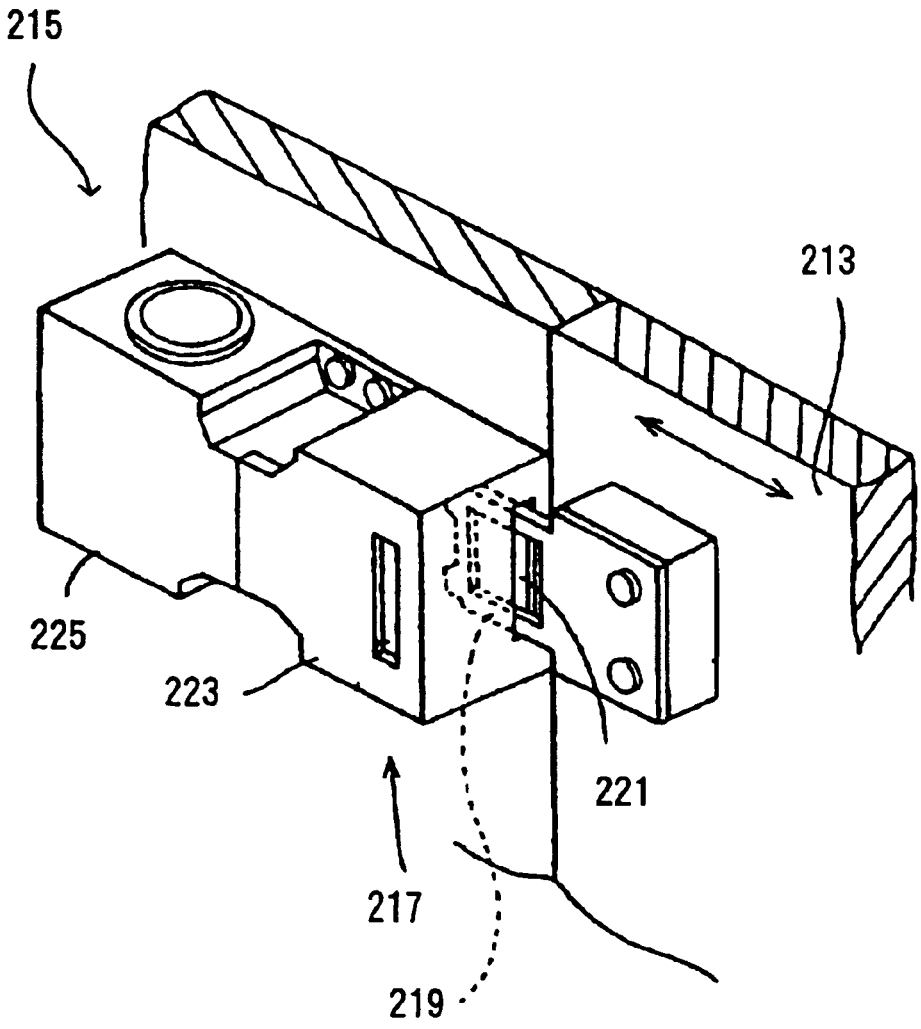
FIG. 18 is a fragmentary perspective view showing a part of the controller for industrial machinery of FIG. 17.
Figure 19:
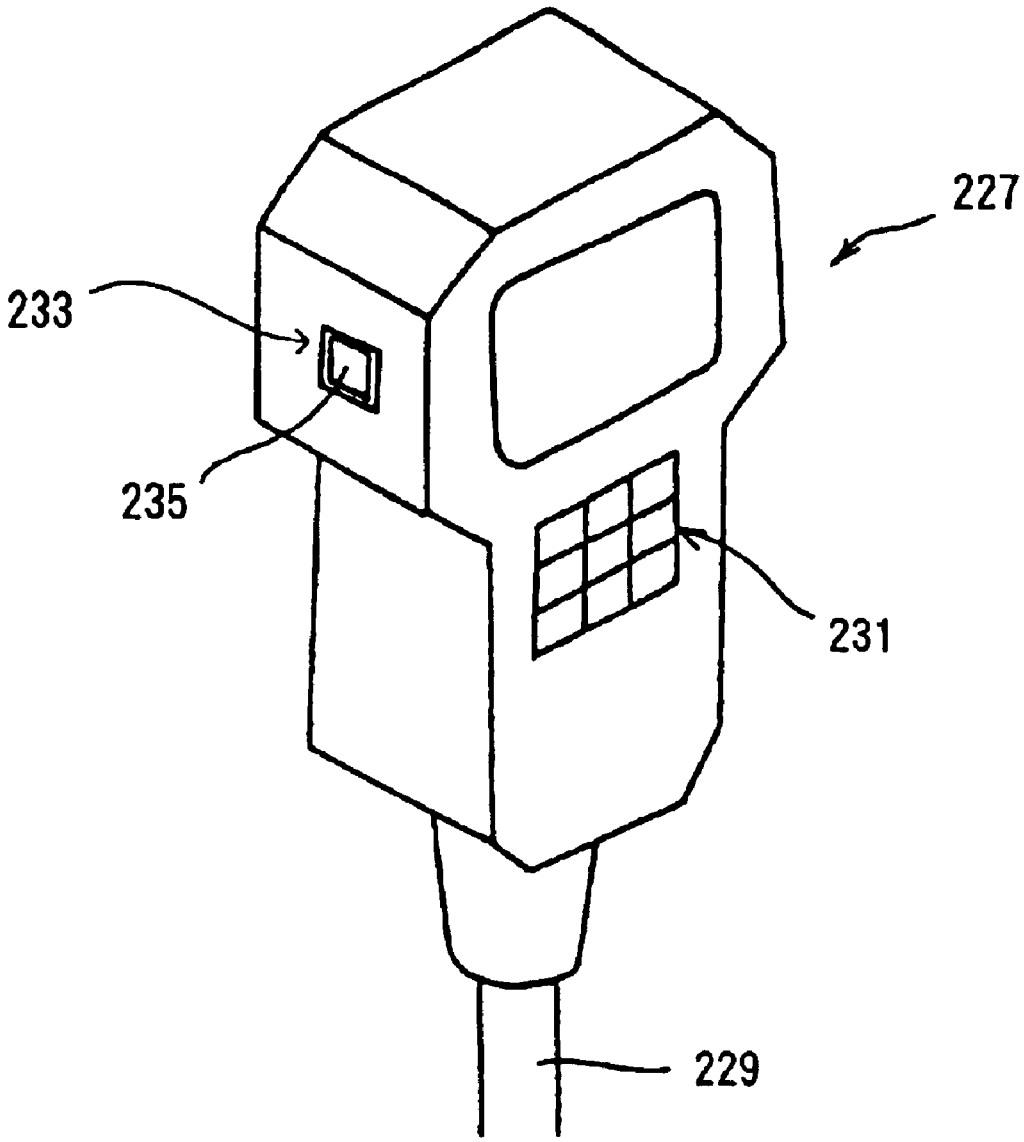
FIG. 19 is a fragmentary perspective view showing another part of the controller for industrial machinery of FIG. 17.
Figure 20:
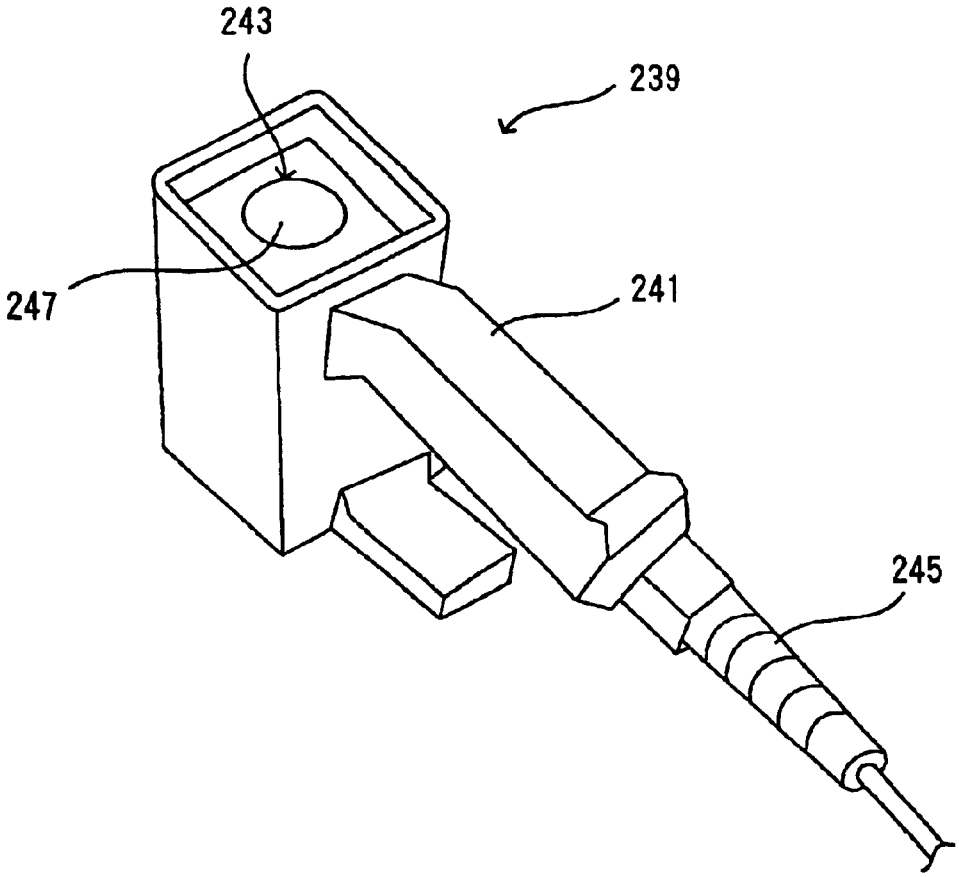
FIG. 20 is a perspective view showing a conventional example.

In this embodiment, an essential configuration of a controller for industrial machinery 201 employing the grip type switch device is substantially the same as that shown in FIGS. 17 to 19 and therefore, the following description is made with reference to these figures as well, so that the redundancy is obviated.

As shown in FIGS. 1 and 2, a grip type switch device 1 according to the embodiment comprises a switch case 3 designed to be held by one hand; a push-button switch 5 disposed in the switch case 3; a multicore cable 7 including a plurality of cores, one end 6 of which is removably attached to the switch case 3 and the other end of which is connected with the control panel 209 (see FIG. 17); and a terminal block 9 as connection means which is disposed in the switch case 3 for electrically connecting contacts of the push-button switch 5 with the cable 7.

As shown in FIGS. 1 and 2, the switch case 3 comprises a cover member 11 and a case body 13, the cover member 11 removably attached to the case body 13.

The case body 13 is formed with a lead-in aperture 15 at one end thereof, through which the one end 6 of the cable 7 is inserted. The lead-in aperture 15 is provided with a cylindrical watertight packing 17 which closes gap between the one end 6 of the cable 7 and the case body 13 thereby preventing water invasion. A protective member 19 of an elastic material, such as rubber, is spirally wound around an outside surface of the one end 6 of the cable 7. The protective member 19 protects the one end 6 of the cable 7 from a direct external force applied thereto during the use of the grip type switch device 1, whereby the cable 7 is prevented from being bent or twisted heavily.

As inserted into the case body 13, the one end 6 of the cable 7 is removed of sheath thereof for exposing multiple cores 21 thereof, leading ends 23 of which are removed of jacket for exposing conductors in the individual cores 21. The exposed conductor portions are removably connected with the terminal block 9. It is noted here that the exposed conductor portions at the leading ends 23 of the cores 21 constitute conductive connection portions on the other side according to the present invention.

On the other hand, a guard member 27 such as formed of a hard resin material is removably attached to the switch case 3 for partially covering a push button 25 of the push-button switch 5. One end 29 of the guard member 27 is fixed to a bottom of the case body 13 by way of a screw 31. In a case where an operator grips the switch case 3 in his right hand in order to manipulate the grip type switch device 1, the guard member 27 may be fixed to the switch case 3 as shown in FIG. 3A. In a case where the switch case 3 is gripped by the left hand, as shown in FIG. 3B, the guard member 27 may be fixed to the switch case 3 in the opposite orientation to that shown FIG. 3A.

The guard member 27 thus fixed makes it impossible to hold the push-button switch 5 in the ON state by wrapping an adhesive tape around the switch case, for example, because the guard member 27 prevents the adhesive tape from pressing down on the push button 25. That is, the guard member 27 obviates a wrong use of the switch device wherein the adhesive tape is wrapped around the switch case to hold the push-button switch 5 in the ON state while the operator neglects to hold the push-button switch depressed.

On the other hand, the cover member 11 is centrally formed with an elongate hole 33 for insertion of the push button 25 such that the push button 25 of the push-button switch 5 in the switch case 3 projects outwardly from the elongate hole 33. The cover member 11 is further formed with projections 35*a*, 35*b* at longitudinally opposite ends thereof, the projections projecting further outward than the push button 25. The projections 35*a*, 35 are so formed as to guard the opposite ends of the push button 25, thereby preventing the push-button switch 5, which is placed on a flat plane for example, from being accidentally depressed ON.

Two LEDs 37*a*, 37*b* as indication means are provided at an end face, on the other side, of the cover member 11 or at an end face of the projection 35*a*, the LEDs emitting lights of different colors (red and green, for example) for indicating the ON and OFF states of the push-button switch 5, respectively. For instance, the LED 37*a* is ON during the OFF state of the push-button switch 5, whereas the other LED 37*b* is ON during the ON state of the pus-button switch.

As shown in FIGS. 2 and 4, the terminal block 9 comprises a board 41 connected with terminal pieces 71, 81 forming contacts of the push-button switch 5 (described herein later) via conductors 39; a base 43 of an L-shape in section which is mounted on the board 41 and includes an upper stage 45 and a lower stage 47; and cylindrical conductive connection portions 51*a*, 51*b*, on the one side, which are disposed in plural insertion holes 49*a*, 49*b* formed in the base 43.

The conductor portions of the cores 21 of the cable 7 are inserted in the conductive connection portions 51*a*, 51*b*, on the one side, disposed in the insertion holes 49*a*, 49*b*, respectively. On the other hand, screws 53*a*, 53*b* extended from individual top surfaces of the upper stage 45 and the lower stage 47 are threadedly engaged with the insertion holes 49*a*, 49*b*, respectively. The screws 53*a*, 53*b* are tightened thereby pressing the conductor portions at the leading ends 23 of the cores 21 against the conductive connection portions 51*a*, 51*b* on the one side, respectively. The conductive connection portions 51*a*, 51*b* on the one side are electrically connected with the board 41, so that an ON or OFF signal of the push-button switch 5 is transmitted to the cores 21 of the cable 7 via the conductive connection portions 51*a*, 51*b* on the one side.

The push-button switch 5 is a three-position type switch adapted to be shifted from the first OFF state to the ON state and then to the second OFF state according to the amounts of push-button depression 25. As shown in FIG. 5, for example, the push-button switch 5 comprises a switch case 55 having a rectangular shape in plan; a push button 25 depressibly supported by the switch case 55; a pair of c-contacts 59 adapted to switch ON or OFF the push-button switch 5 and a normally close contact 61, as an auxiliary contact; and a pair of switching mechanisms 63 operatively associated with pressing-down on the push button 25 for switching the c-contacts 59 between an open position and a close position. As seen in the figure, the push-button switch 5 has a symmetrical configuration and therefore, the following description discusses a configuration of only a right half thereof while the explanation of a left half thereof is dispensed with.

As shown in FIG. 5, the normally close contact 61 is disposed centrally downwardly of the switch case 55, whereas the pair of c-contacts 59 having a snap action configuration are disposed at opposite ends of the switch case as sandwiching the normally close contact 61 therebetween.

The normally close contact 61 comprises a movable member 65 disposed in the switch case 55 and projecting toward the push button 25 (upwardly) as urged upward by a helical spring 64 disposed therebelow; a pair of movable terminals 67 attached to the movable member 65; and a pair of stationary terminals 69 brought into or out of contact with the movable terminals 67. In an initial state, the movable member 65 is urged upward by the helical spring so that the normally close contact 61 is closed with the movable terminals 67 thereof contacting the stationary terminals 69 thereof. The stationary terminals 69 are electrically connected with the terminal pieces 71 projected downwardly from the switch case 55, the terminal pieces 71 connected with the board 41 of the terminal block 9 via the conductors 39.

The c-contact 59*a* has the snap action configuration, comprising a movable terminal 73; a normally close stationary terminal 75 and a normally open stationary terminal 77 disposed above and below the movable terminal 73; an operative member 79 for moving the movable terminal 73 between the normally close stationary terminal 75 and the normally open stationary terminal 77; and a helical spring 80 anchored to the operative member 79 and to the movable terminal 73.

When the c-contact 59 is in the initial state or in the first OFF state, the movable terminal 73 thereof is in contact with the normally close stationary terminal 75 as spaced away from the normally open stationary terminal 77 thereof. The movable terminal 73, the normally close stationary terminal 75 and the normally open stationary terminal 77 are electrically connected with the individual terminal pieces 81 projected downwardly from the switch case 55, the terminal pieces 81 connected with the board 41 of the terminal block 9 via the conductors 39.

The switching mechanism 63 is disposed in an accommodating portion 83 defined in the push button 25. The switching mechanism 63 comprises a pressing piece 85 for pressing the operative member 79 of the c-contact 59; a slide block 87 operatively associated with pressing-down on the push button 25 for depressing the pressing piece 85; and a pressing shaft 89 engaged with the slide block 87.

The pressing shaft 89 is formed with a pair of flanges 91*a*, 91*b* at an upper end thereof. One 91*a* of the flanges is formed with a slope 93. The pressing shaft 89 has a hollow structure such that a helical spring 95 anchored to an upper inside surface of the accommodating portion 83 is anchored to place in the pressing shaft 89.

The slide block 87 is formed with a cavity 97 vertically extended therethrough, whereas the pressing shaft 89 is inserted through the cavity 97. The slide block 87 is formed with a slope 101 at an inside wall of one end 99 thereof, the slope 101 engaged with the slope 93 of the pressing shaft 89. A helical spring 103 is interposed between the one end 99 of the slide block 87 and a side wall of the accommodating portion 83, the helical spring 103 serving to urge the slide block 87 toward the center of the push button 25. The other end 105 of the slide block 87 is adapted to abut against an upper end of the pressing piece 85.

When the push button 25 of the push-button switch 5 in the initial or first OFF state shown in FIG. 5 is depressed, the pressing piece 85 pushes down the operative member 79 of the c-contact 59 as operatively associated with pressing-down on the push button 25, as shown in FIG. 6. Thus, the movable terminal 73 is moved away from the normally close stationary terminal 75 to be brought into contact with the normally open stationary terminal 77, so that the push-button switch 5 is shifted to the ON state.

When the push button 25 of the push-button switch 5 in the ON state is further depressed, the slope 101 of the slide block 87 slides on the slope 93 of the pressing shaft 89, so that the slide block 87 is moved outwardly relative to the push button 25, as shown in FIG. 7. The movement of the slide block 87 releases the other end 105 thereof from the engagement with the upper end of the pressing piece 85 which, in turn, is allowed to move upwardly to release the pressure on the operative member 79. This causes the movable terminal 73 to move away from the normally open stationary terminal 77 and to come into contact with the normally close stationary terminal 75. Thus, the push-button switch 5 in the ON state is shifted to the second OFF state.

At this time, the movable member 65 of the normally close contact 61 in the push-button switch 5 is pushed down by the push button 25, so that the movable terminals 67 are moved away from the stationary terminals 69 to open the normally close contact 61. That is, the normally close contact 61 is closed in the first OFF state and is opened in the second OFF state. Therefore, whether the push-button switch 5 is in the first OFF state or in the second OFF state can be readily determined by monitoring the state of the normally close contact 61.

In a case where a part of the cable 7 is damaged so that the grip type switch device 1 requires the replacement of the cable 7, the cover member 11 of the switch case 3 is first removed. Subsequently, the individual screws 53*a*, 53*b* at the upper stage 45 and the lower stage 47 of the terminal block 9 are loosened to release the pressure on the conductive connection portions 51*a*, 51*b*, on the one side, of the conductor portions of the cable 7. This state allows the conductor portions of the cable 7 to be extracted from the insertion holes 49*a*, 49*b* in the terminal block 9. Subsequently, the cable 7 with the cores 21 is drawn out from case body 13 to be replaced by a new cable.

On the other hand, the new cable may be mounted to the switch case 3 by performing the above steps in the reversed order. Specifically, the cores 21 are first drawn out from the one end 6 of the cable 7. The one end 6 of the cable 7 is inserted through the lead-in aperture 15 via the watertight packing 17. Then, the sheath of the cable 7 is removed to expose the cores 21, the leading ends 23 of which are also removed of the jacket thereof to expose the conductor portions. The exposed conductor portions are individually inserted in the insertion holes 49*a*, 49*b* of the terminal block 9. Subsequently, the screws 53*a*, 53*b* are tightened to press the conductor portions against the conductive connection portions 51*a*, 51*b* on the one side thereby establishing the electrical connection. Finally, the cover member 11 is fixed to the case body 13 to finish the replacement of the cable 7.

Next, description is made on the operations of the industrial machinery 203 operated by means of the grip type switch device 1. In a case where the industrial machinery 203 is subjected to program teaching or manually operated, the operator responsible for the program teaching brings the teaching pendant 227 with him into the zone inside of the safety fence 207 whereas the other assistant operators bring the grip type switch devices 1 with themselves into the zone inside of the safety fence 207. At this time, the door 213 in the doorway 205 of the safety fence 207 is held open. Thus, the actuator 219 fixed to the door 213 is extracted from the switch body 217 of the safety switch 215 and hence, the industrial machinery 203 is deactivated to be placed in a mode to be manually operated by way of the teaching pendant 227 or any of the grip type switch devices 1.

When the program is taught to the industrial machinery 203, the teaching operation or the like is carried out in a state where the operator holds the push-button switch 233 of the teaching pendant 227 in the ON state while at the same time, the assistant operators hold the push-button switches 5 of the grip type switch devices 1 in the ON state.

While the push-button switch 5 is ON, the LED 37*a* of the switch case 3 goes out whereas the LED 37*b* comes on. Therefore, the assistant operator can visually determine that the push-button switch 5 is in the ON state where the teaching operation is permitted. On the other hand, the push-button switch 233 of the teaching pendant 227 is also enabled for teaching to the industrial machinery 203 when shifted to the ON state.

In a case where any of the assistant operators is aware of abnormality such as contact with the industrial machinery 203, the assistant operator can press further down on the push button 25 of the push-button switch 5, thereby shifting the push-button switch 5 in the ON state to the second OFF state. Thus, the manual operation of the industrial machinery 203 is disabled irrespective of the manipulation of the teaching pendant 227.

According to the first embodiment described above, the leading ends 23 of the cable 7 introduced into the switch case 3 are removably held in electrical connection with the c-contacts 59 of the push-button switch 5 by means of the terminal block 9. Even in the case of damage to the cable 7, therefore, the damaged cable 7 may be readily replaced by removing the cores 21 thereof from the terminal block 9 and then removing the cable 7 from the switch case 3. That is, the cable 7 alone can be replaced when the cable 7 is damaged. This results in a lower maintenance cost than the conventional example wherein the damaged cable 7 requires the replacement of the whole grip type switch device.

In addition, the less costly terminal block 9, as the connection means, is used for connecting the cable 7 with the c-contacts 59 of the push-button switch 5. Accordingly, the grip type switch device 1 can be constructed in a simple structure at low cost which results in the reduction of maintenance cost.

Although the embodiment described above employs the terminal block 9 as the connection means for interconnecting the cable 7 and the contacts of the push-button switch 5, the present invention is not limited to this. For instance, an arrangement shown in FIG. 8 may be made.

Figure 8:
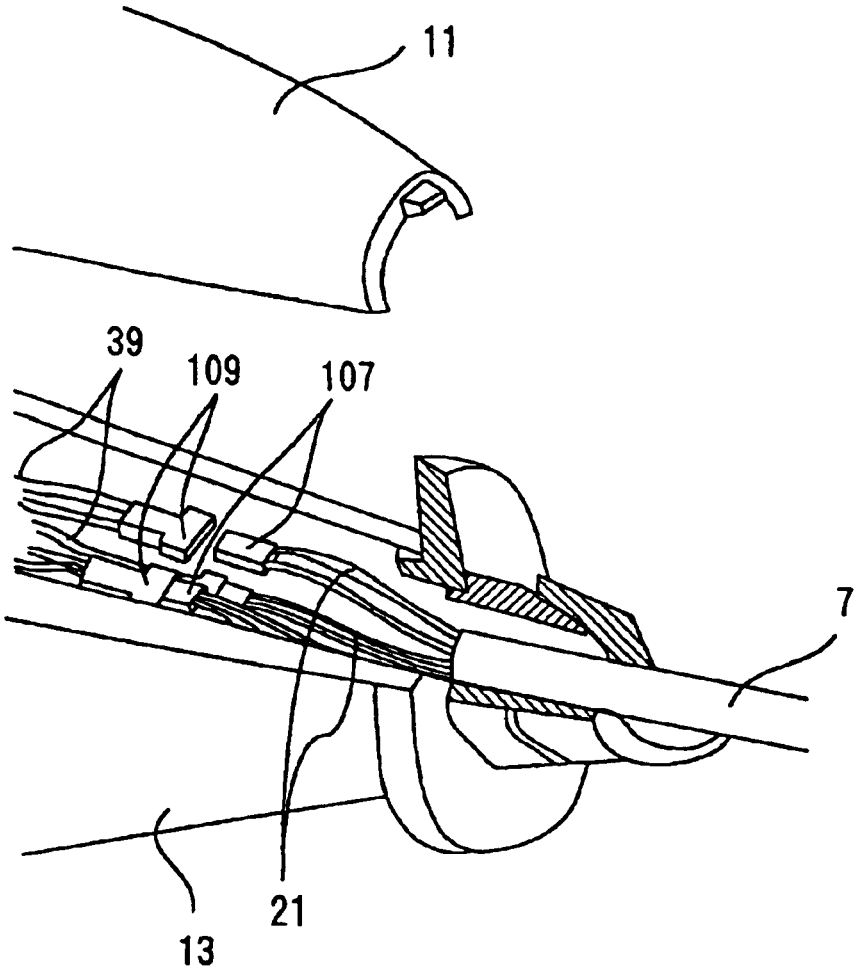
FIG. 8 is a fragmentary perspective view showing a part of an exemplary modification of the first embodiment hereof.

Instead of using the terminal block 9, the arrangement shown in FIG. 8 may be made such that a connector portion 107 for the cable is connected with the exposed conductor portions of the cores 21 of the cable 7 whereas a connector portion 109 for the switch is connected with the leading ends of the conductors 39 connected with the c-contacts 59 of the push-button switch 5, and that the connector portion 107 for the cable is removably fitted with the connector portion 109 for the switch thereby electrically connecting the c-contacts 59 of the push-button switch 5 with the cable 7. It is noted here that a connector comprising the connector portion 107 for the cable and the connector portion 109 for the switch constitutes the connection means of the present invention.

Likewise to the first embodiment described above, such an arrangement also provides the easy and removable connection between the cable 7 and the push-button switch 5. Furthermore, the connection means is constituted by the less costly connector consisting of the connector portions 107, 109 and hence, the maintenance cost for the grip type switch device 1 can be reduced.

In addition, the switch case 3 may be further provided with a drive switch 111 for another device at the other end thereof, which is opposite to the one end thereof through which the cable 7 is introduced. The device activated by the drive switch 111 may be exemplified by an alarm (not shown) disposed in a factory, for example. The drive switch 111 integrated with the grip type switch device 1 may be manipulated to activate the alarm which outputs a buzzer sound or the like. The buzzer sound or the like ensures that any person outside of the safety fence 207 is informed of an emergency inside of the safety fence 207 even in the noises of the factory.

Another example of the device to be activated by the drive switch 111 may be the industrial machinery 203 itself. Specifically, an arm of the industrial machinery 203 may be manually driven for teaching, whereby in addition to the operator of the teaching pendant 227, the assistant operator with the grip type switch device 1 is also permitted to perform the teaching operation to the industrial machinery 203. This leads to an increased efficiency of the work. It is noted that the drive switch 111 is not limited to the above and may be designed to activate any other device.

Figure 10:
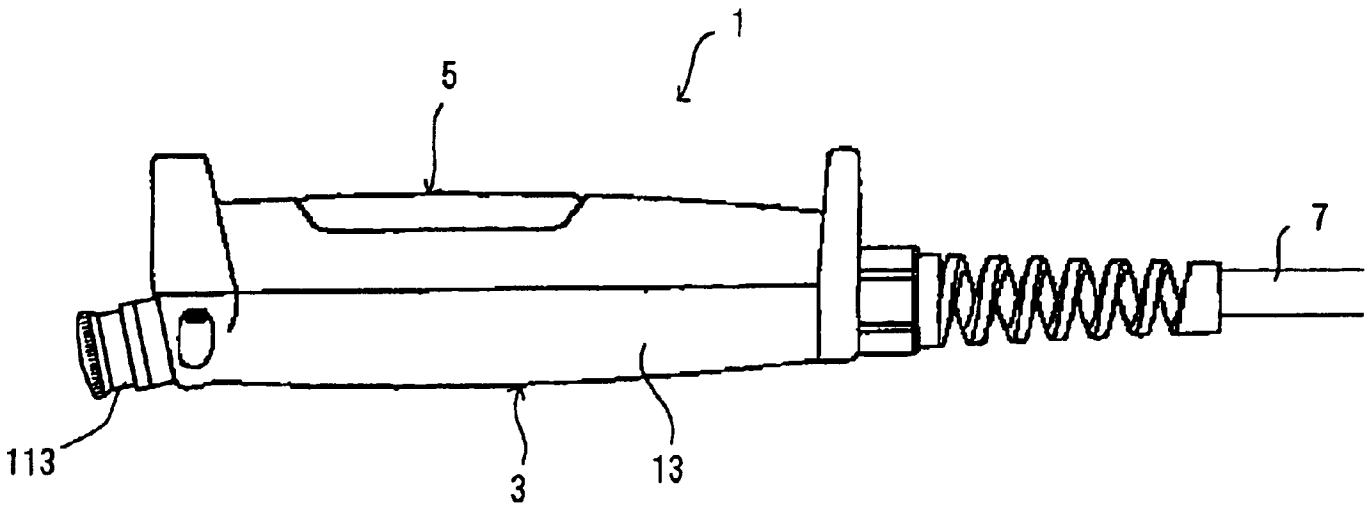
FIG. 10 is a side elevation showing another exemplary modification of the first embodiment hereof.

Furthermore, as shown in FIG. 10, the switch case 3 may be provided with an emergency stop switch 113 for the controller 201 (see FIG. 17) at the other end thereof which is opposite to the one end thereof through which the cable 7 is introduced. The provision eliminates the need for the operator to rush to any of the emergency stop switches 211 inside and outside of the safety fence 207 and to manipulate it, in the event of abnormal conditions of the industrial machinery 203, for example. The controller 201 can be brought into an emergency stop by manipulating the emergency stop switch 113 at the grip type switch device 1.

Therefore, the embodiment provides for a quick emergency stop of the controller 201 in case of abnormal conditions of the industrial machinery 203 or the like, thus ensuring the safety during the work. Such an emergency stop switch 113 may preferably be of a push-lock and turn-reset system, for example.

In the first embodiment described above, the two LEDs 37*a*, 37*b* indicating the ON and OFF states of the push-button switch 5 may not necessarily be provided. Further, the drive switch 111 shown in FIG. 9 or the emergency stop switch 113 shown in FIG. 10 may not necessarily be provided.

(Second Embodiment)

A second embodiment of the present invention will be described with reference to FIGS. 11 to 13, which are sectional views each showing a different state of a push-button switch disposed in a switch case. Since essential configurations of the switch case 3, cable 7 and connection means of the grip type switch device 1 of the embodiment are substantially the same as those of the first embodiment, the following description principally discusses differences from the first embodiment with reference to FIGS. 1 to 4 as well, so that the redundancy is obviated.

In the grip type switch device of the embodiment, a configuration of the push-button switch disposed in the switch case 3 differs from that of the first embodiment. Specifically, the first embodiment employs the push-button switch 5 of the snap action type, whereas this embodiment employs the push-button switch of a slow action type.

Figure 11:
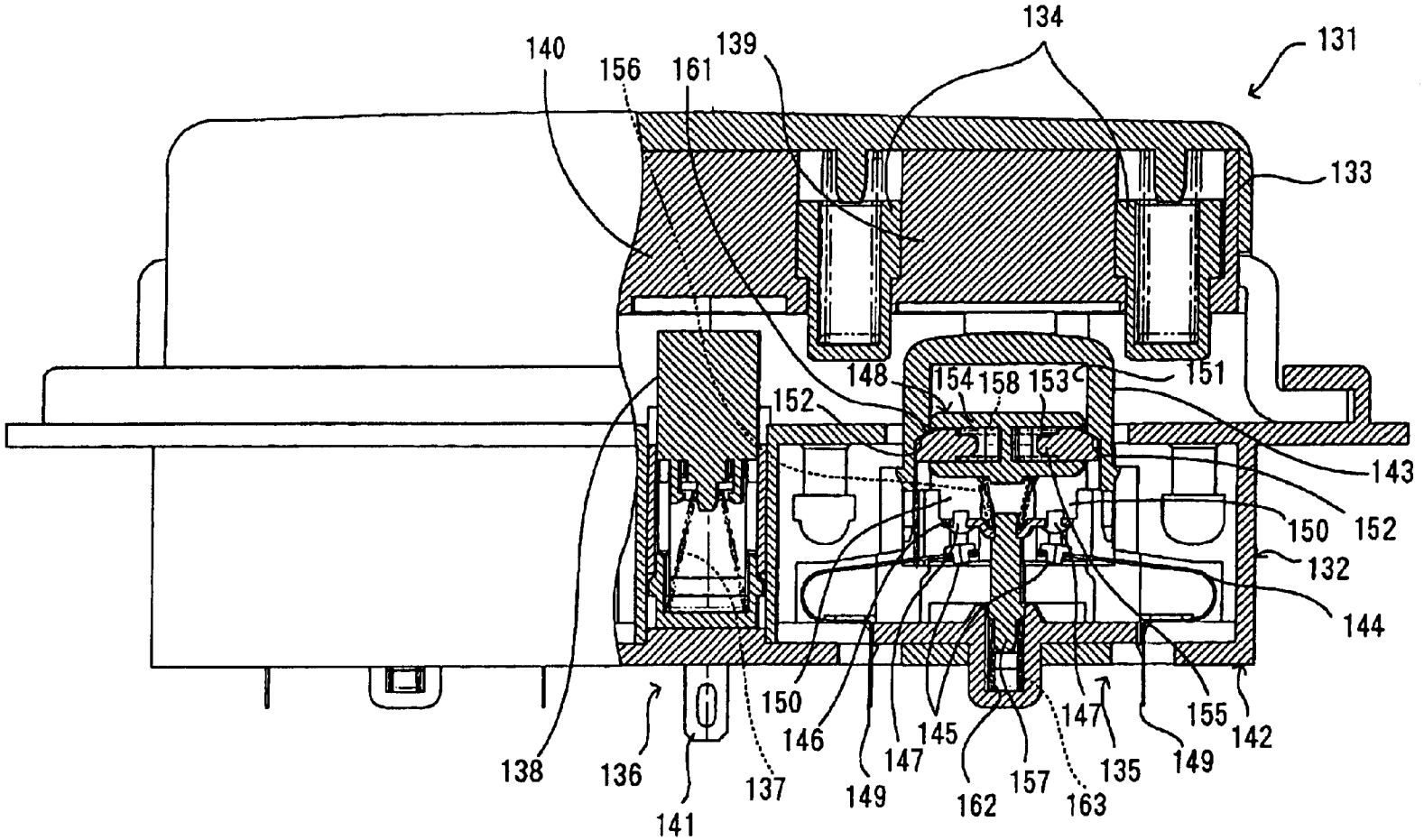
FIG. 11 is a sectional view showing one state of a part of a second embodiment of the present invention.

As shown in FIG. 11, a push-button switch 131 comprises a switch case 132 having a rectangular shape in plan; a push button 133 depressibly supported by the switch case 132; two pairs of pressing elements 134 for producing additional load on the push button when the push-button switch 131 in the ON sate is shifted to the second OFF state; and a pair of switch elements 135 for switching ON or OFF the push-button switch and a normally close contact 136 as an auxiliary contact. As seen in the figure, the push-button switch 131 has a symmetrical configuration and therefore, the following description discusses a configuration of only a right half thereof while the explanation of a left half thereof is dispensed with.

Inside of the push button 133, there are disposed a first pressing member 139 operatively associated with pressing-down on the push button 133 for depressing the switch element 135, and a second pressing member 140 operatively associated with pressing-down on the push button 133 for depressing the normally close contact 136. The normally close contact 136 is located centrally of the switch case 132, whereas the pair of switch elements 135 having the slow action configuration are located at opposite ends of the switch case as sandwiching the normally close contact 136 therebetween.

The normally close contact 136 is essentially configured the same way as the normally close contact 61 of the first embodiment described above. Specifically, as shown in FIG. 11, the normally close contact 136 comprises a movable member 138 disposed in the switch case 132 and projecting toward the push button 133 (upwardly) as urged upward by a helical spring 137 disposed therebelow; a pair of movable terminals (not shown) attached to the movable member 138; and a pair of stationary terminals (not shown) brought into or out of contact with the movable terminals. In an initial state, the movable member 138 is urged upward by the helical spring 137, while the movable terminals and the stationary terminals are in contact with each other to establish a closed state. The stationary terminals are electrically connected with a terminal piece 141 projecting downwardly from the switch case 132, the terminal piece 141 connected with the board 41 of the terminal block 9 via the conductor 39 (see FIG. 4).

The switch element 135 comprises a case portion 142; a depression member 143 depressibly supported by the case portion 142; a pair of stationary terminals 145 each attached to one end of a leaf spring 144 disposed in the case portion 142; a pair of movable terminals 147 attached to a bracket 146 and brought into or out of contact with the stationary terminals 145; and a switching mechanism 148 operatively associated with pressing-down on the depression member 143 for bringing the movable terminals 147 into contact with the stationary terminals 145, but adapted to move the movable terminals 147 away from the stationary terminals 145 when the depression reaches a predetermined amount. Each of the leaf springs 144 is formed of a conductive member, the other end of which projects downwardly from the switch case 132 to define a terminal piece 149, which is connected with the board 41 of the terminal block 9 via the conductor 39. It is noted here that the movable terminal 147 and the stationary terminal 145 of the switch element 135 constitute an a-contact.

An accommodating portion 151 of a rectangular shape in plan is defined in the depression member 143, and is formed with slopes 152 at opposite side walls thereof. On the other hand, a pair of projections 150 for pressing down on the leaf springs 144 are provided at a bottom of the depression member 143.

The switching mechanism 148 comprises an insertion member 154 disposed in the accommodating portion 151 of the depression member 143 and formed with a pair of cavities 153; a pair of slide blocks 155 disposed in the individual cavities 153 of the insertion member 154 as allowed to move horizontally (lateral directions as seen in FIG. 11); a helical spring 156 coupling the insertion member 154 with the bracket 146 for urging the movable terminals 147 downwardly; and a shaft member 157 projecting downwardly from the bracket 146.

The slide blocks 155 are urged toward opposite ends of the depression member 143 by means of helical springs 158 disposed in the cavities 153 of the insertion member 154. The slide blocks 155 are each formed with a slope 161 at one end thereof, the slope 161 engaged with each corresponding slope 152 of the depression member 143.

The shaft member 157 has its lower part inserted in a hole 162 formed at a bottom of the case portion 142. The hole 162 receives a return spring 163, an upper end of which is anchored to a lower end of the shaft member 157. The shaft member 157 is constantly urged upward by means of an urging force of the return spring 163.

Figure 12:
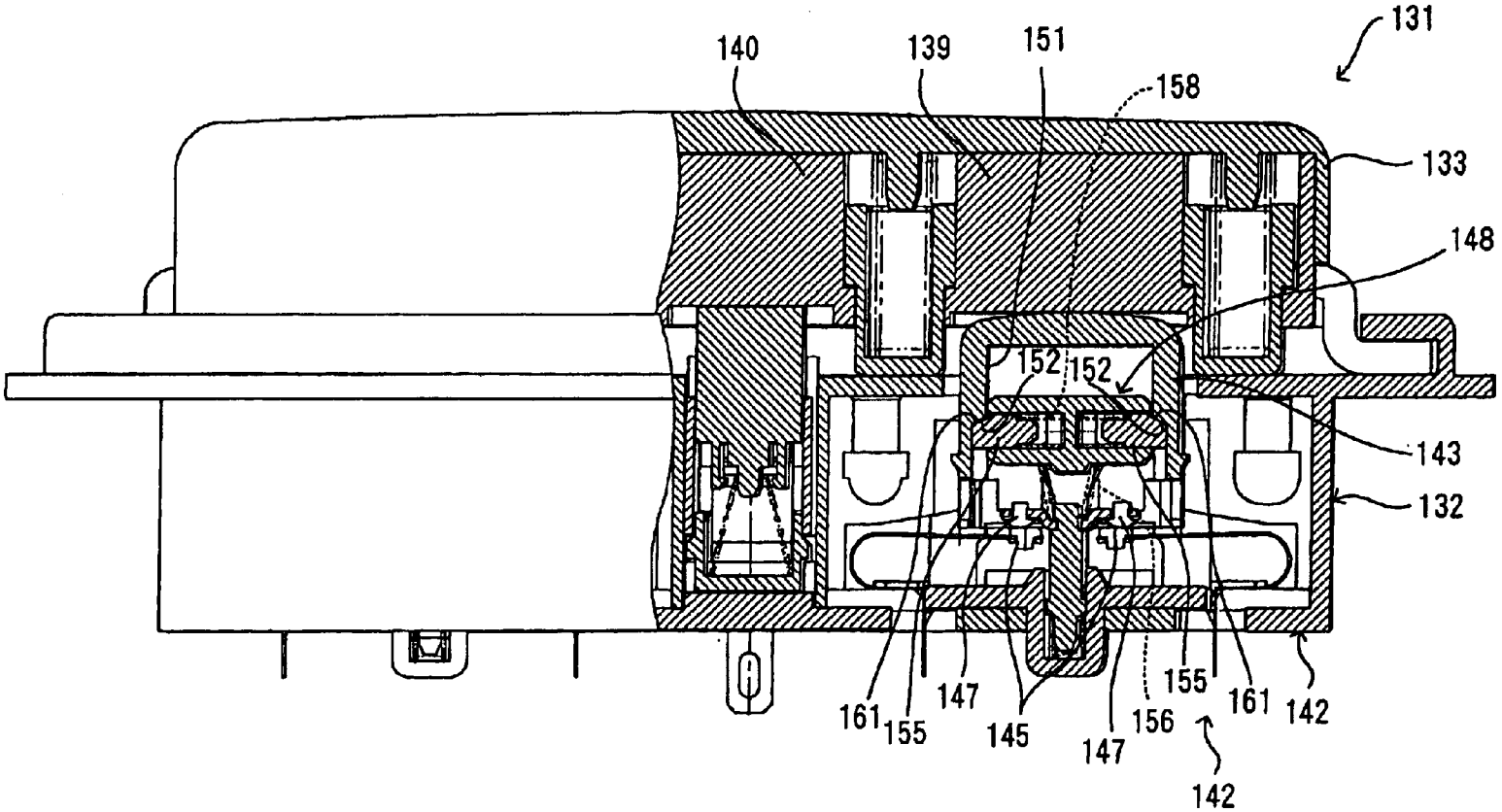
FIG. 12 is a sectional view showing another state of the above part of the second embodiment hereof.
Figure 13:
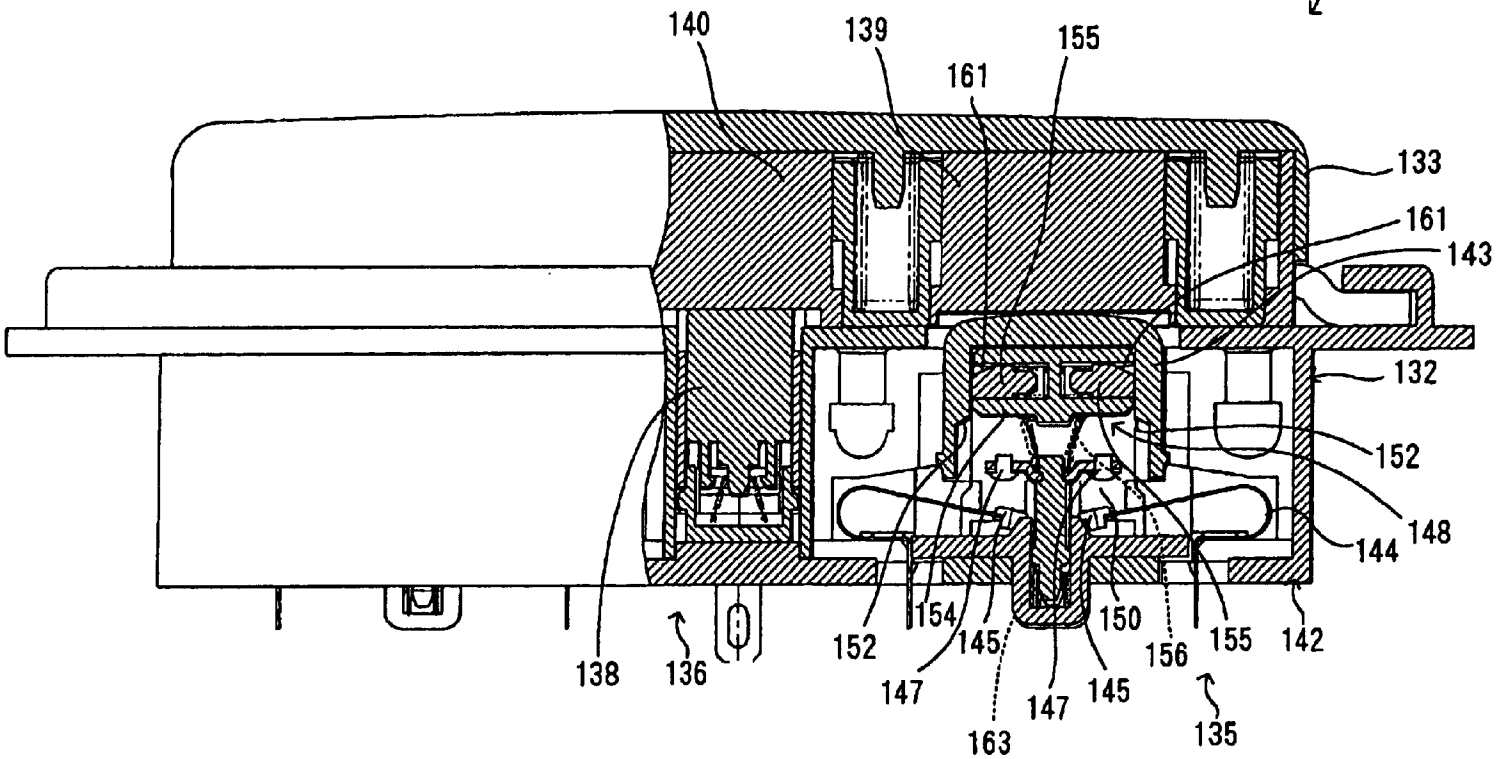
FIG. 13 is a sectional view showing still another state of the above part of the second embodiment hereof.

When the push button 133 in the first OFF state (undepressed) is pressed down, the first pressing member 133 of the push button 133 presses down on an upper surface of the depression member 143, as shown in FIG. 12. Thus, the switching mechanism 148 operatively associated with the depression member 143 is moved down to push down the movable terminals 147, which come into contact with the stationary terminals 145. In this state, the push-button switch 131 is shifted to the ON state, enabled for teaching operation to the industrial machinery 203 (see FIG. 17).

At this time, pressing forces from the slopes 152 of the accommodating portion 151 act on the slopes 161 of the slide blocks 155 to move the slide blocks 155 inwardly. However, the urging force of the helical spring 156 urging the slide blocks 155 upwardly overcomes the pressing forces, so that the slide blocks 155 are not moved, maintained in the engaged relation with the depression member 143.

When the operator, being aware of any potential danger, presses further down on the push button 133 in the ON state, the urging force of the helical spring 156 overcomes the forces urging the slide blocks 155 outwardly, so that the slide blocks 155 with their slopes 161 sliding on the slopes 152 of the accommodating portion 151 are moved inwardly of the insertion member 154 against the helical springs 158. As a result, the slide blocks 155 are released from the engaged relation with the depression member 143 so that the switching mechanism 148 is moved upward by means of the return spring 163, as shown in FIG. 13. This also moves up the movable terminals 147, which go out of contact with the stationary terminals 145, so that the push-button switch 131 is shifted to the second OFF state where the industrial machinery is deactivated. At this time, the projections 150 of the depression member 143 push down the leaf springs 144, thereby forcefully moving the movable terminals 147 away from the stationary terminals 145 even if the movable terminals 147 are fused to the stationary terminals 145, for example. Thus is ensured that the push-button switch 131 in the ON state is positively shifted to the second OFF state.

On the other hand, when the push-button switch 131 in the ON state is shifted to the second OFF state, the movable member 138 of the normally close contact 136 is pushed down by the second pressing member 140 of the push button 133. Therefore, the movable terminals of the normally close contact 136 go out of contact with the stationary terminals thereby to open the normally close contact 136. Thus, the normally close contact 136 is closed in the first OFF state, and is opened in the second OFF state. Accordingly, the push-button switch 131 can be readily determined to be in the first OFF state or in the second OFF state by monitoring the normally close contact 136.

In this embodiment wherein the push-button switch 131 of the slow action type is employed in place of the push-button switch 5 of the snap action type, it goes without saying that the cable 7 can be readily replaced at low cost just as in the first embodiment. The push-button switch 131 can be set to any of three positions (the first OFF state, the ON state and the second OFF state) according to the amounts of push-button depression 133. The push-button switch 131 provides for a tangible indication of intent of the operator, such that the safety of the operator is ensured.

(Third Embodiment)

Figure 14:
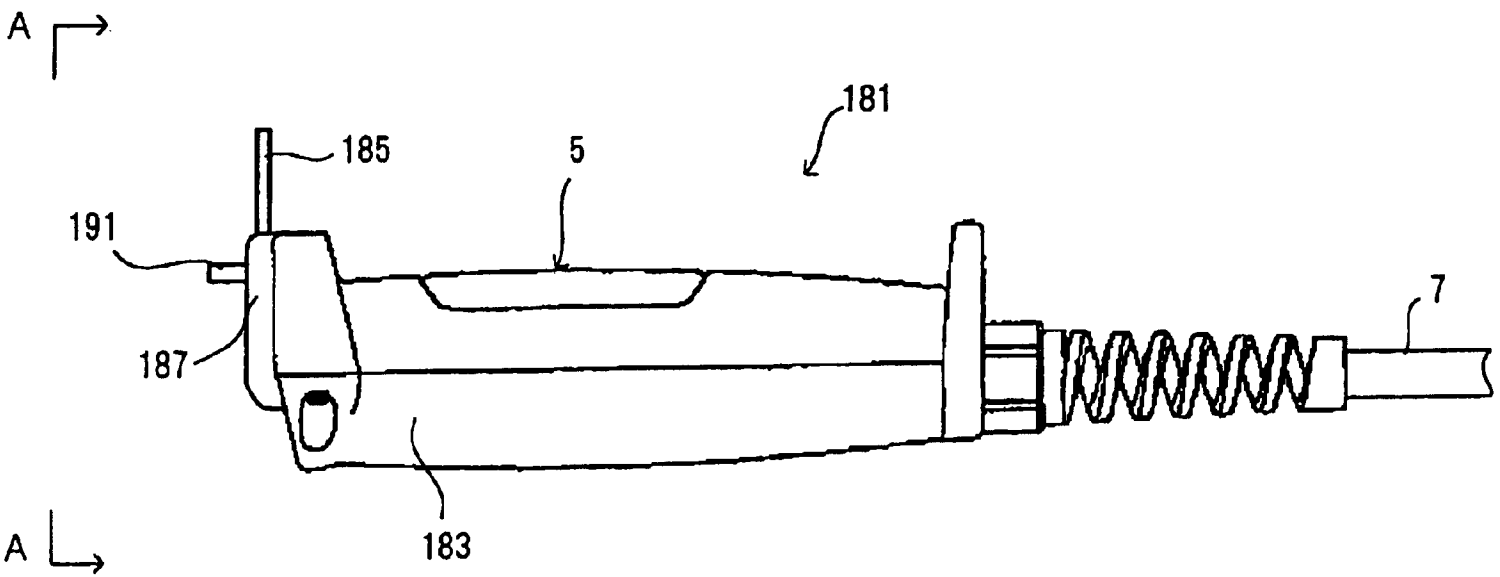
FIG. 14 is a side elevation showing a third embodiment of the present invention.
Figure 15:
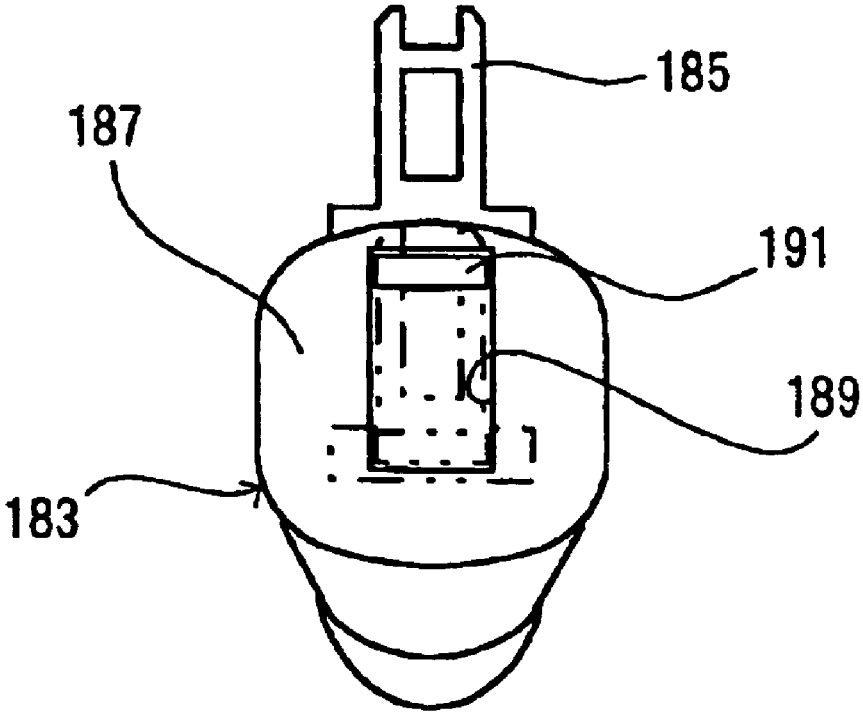
FIG. 15 is a sectional view taken on the line A—A in FIG. 14.
Figure 16:
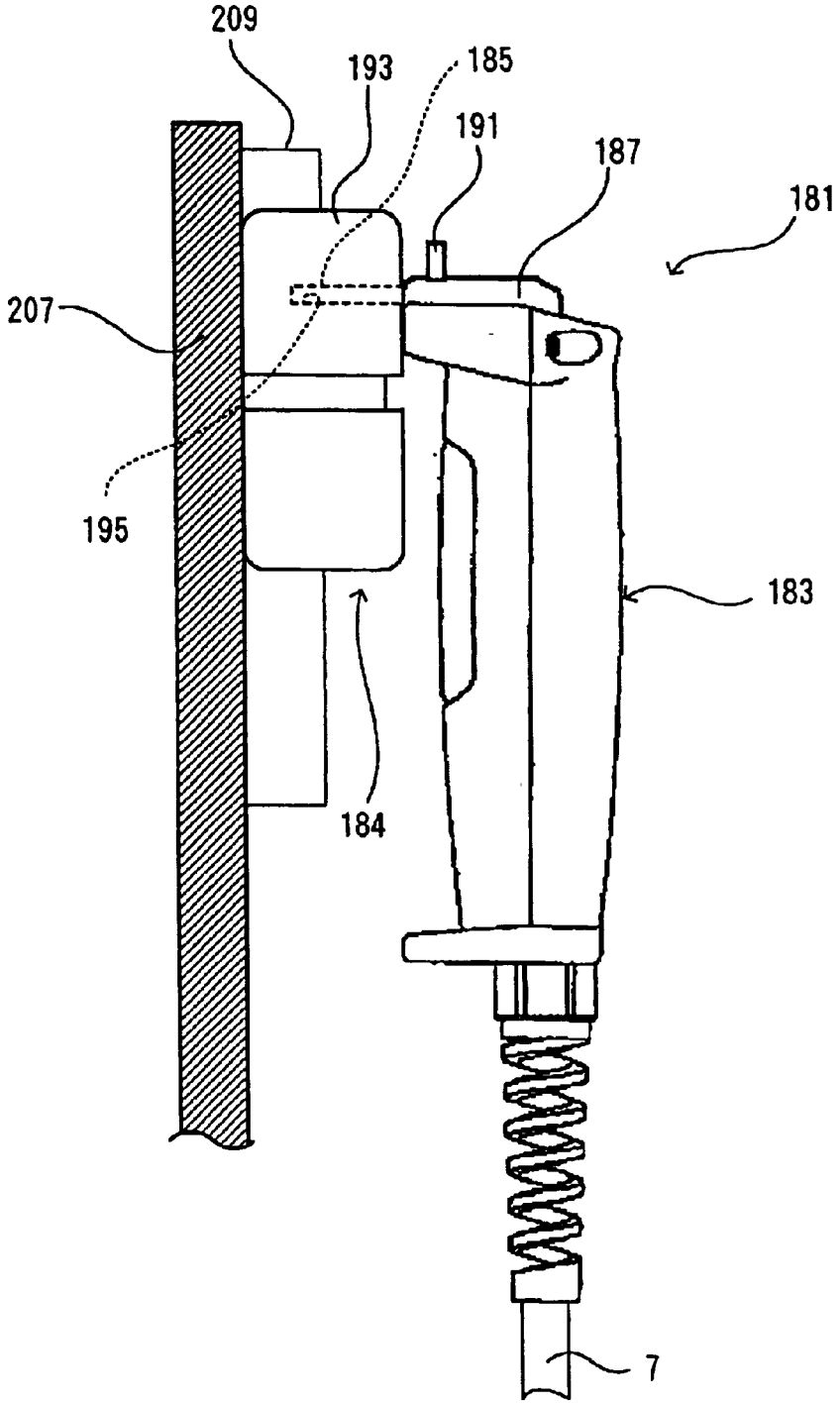
FIG. 16 is a diagram illustrative of how the third embodiment hereof is used.

A third embodiment will be described with reference to FIGS. 14 to 16. FIG. 14 is side elevation showing a grip type switch device, whereas FIG. 15 is a sectional view taken on the line A—A in FIG. 14. FIG. 16 is a diagram illustrative of how the grip type switch device is used.

In this embodiment, an essential configuration of a controller for industrial machinery 201 employing the grip type switch device is substantially the same as that shown in FIGS. 17 to 19 and therefore, the following description is made with reference to these figures as well, while obviating the redundancy. In this embodiment, essential configurations of the push-button switch 5, the connection means and the cable 7 of a grip type switch device 181 are substantially the same as those of the first embodiment, as shown in FIGS. 17 to 19 and therefore, the following description principally discusses differences from the first embodiment while obviating the redundancy.

The grip type switch device 181 of this embodiment differs from that of the first embodiment in the configuration of a switch case 183. Furthermore, this embodiment differs from the first embodiment in that the controller 201 is provided with a safety switch 184.

As shown in FIG. 14, the switch case 183 is provided with a receiving portion 187 for receiving an actuator 185 at the other end thereof which is opposite to the one end thereof through which the cable 7 is introduced. The actuator 185 is retractably disposed in the receiving portion 187.

As shown in FIGS. 14 and 15, the receiving portion 187 is formed with an aperture 189 at an end face thereof. An operation lever 191 fixed to one surface of the actuator 185 projectingly extends through the aperture 189. The actuator 185 may be projected from the receiving portion 187 or retracted into the receiving portion 187 by manipulating the operation lever 191. In this case, a lock mechanism (not shown) is provided such that the actuator 185 in the projected position is less prone to be retracted into the receiving portion 187 or that the actuator 185 in the retracted position is less prone to be projected from the receiving portion 187.

The safety switch 184 is electrically connected with the control panel 209 (see FIG. 17) disposed on the safety fence 207, as shown in FIG. 16. The safety switch 184 is essentially configured the same way as the safety switch 215 shown in FIG. 17 and comprises a case body 193 and c-contacts (not shown) disposed in the case body. A main difference from the safety switch 215 shown in FIG. 18 is that the actuator 185 is mounted to the switch case 183 rather than to the door 213. The safety switch 184 is fixed to the outside surface of the safety fence 207 in adjoining relation with the control panel 209.

As shown in FIG. 16, the case body 193 is formed with an insertion hole 195 on one surface thereof, the insertion hole 195 adapted to receive the actuator 185. In a case where the grip type switch device 181 is not used or where the industrial machinery (industrial robot) 203 is externally controlled via the control panel 209 (see FIG. 17), the grip type switch device 181 is mounted to the safety switch 184 by inserting the actuator 185 in the insertion hole 195.

The c-contacts of the safety switch 184 is electrically connected with the control panel 209 (see FIG. 17) and hence, the contacts of the safety switch 184 are closed when the actuator 185 is inserted in the safety switch 184 whereby the industrial machinery 203 can be controlled only through the control panel 209. When, on the other hand, the actuator 185 is extracted from the safety switch 184, the c-contacts of the safety switch 184 are opened, so that the control panel 209 is disabled to control the industrial machinery 203 while the industrial machinery 203 can be manually operated only through the teaching pendant 227 (see FIG. 19) or the grip type switch device 181. The safety switch 184 also differs from the safety switch 215 shown in FIG. 17 in that the safety switch 184 functions to switch the control panel 209 between an enable state for control of the industrial machinery 203 and a disable state for control of the same.

In the grip type switch device 181, the cable 7 is connected by way of the terminal block 9 or the connector similarly to the first embodiment described above. Therefore, the cable 7 can be readily replaced by taking the same procedure as in the first embodiment.

Next, description is made on operations of the grip type switch device 181 of the above configuration. In the manual operation of the industrial machinery 203, the grip type switch device 181 is dismounted to extract the actuator 185 from the safety switch 184. This switches the c-contacts in the safety switch 184 so as to disable the control panel 209 to control the industrial machinery 203. Thus, the industrial machinery 203 inside of the safety fence 207 is placed in a mode to be taught only through the teaching pendant 227 or the grip type switch device 181.

Then, while the door 213 in the doorway of the safety fence 207 held open, the operators with the grip type switch devices 181 enter the zone inside of the safety fence 207, where the operators manually operate the industrial machinery 203 or perform the program teaching via the teaching pendant 227. That is, by opening the door 213 of the safety fence 207, the contacts in the safety switch 215 are opened so that the power to the industrial machinery 203 is cut off while only the manual operation is effective.

After the actuator 185 is extracted from the safety switch 184, the operation lever 191 may be manipulated to retract the actuator 185 into the receiving portion 187. This prevents the actuator 185 from contacting the machinery or any other operator during the work.

In the third embodiment, it goes without saying that the cable 7 can be readily replaced at low cost just as in the first embodiment described above. In addition, when the actuator 185 is extracted from the safety switch 184, the c-contacts in the safety switch 184 are shifted so that the control panel 209 is disabled to control the industrial machinery 203, which can be operated only by the grip type switch device 181. Therefore, if anyone outside the safety fence 207 should mistakenly manipulate the control panel 209 during the execution of manual operation of the industrial machinery 203 inside of the safety fence, for example, the industrial machinery 203 is never activated and the safety during the work can be enhanced.

Even if the door 213 of the safety fence 207 is inadvertently closed while the industrial machinery 203 is manually operated, the power supply to the industrial machinery 203 can be inhibited so that the industrial machinery 203 is prevented from being activated. This results in the enhanced safety during the work.

Figure 9:
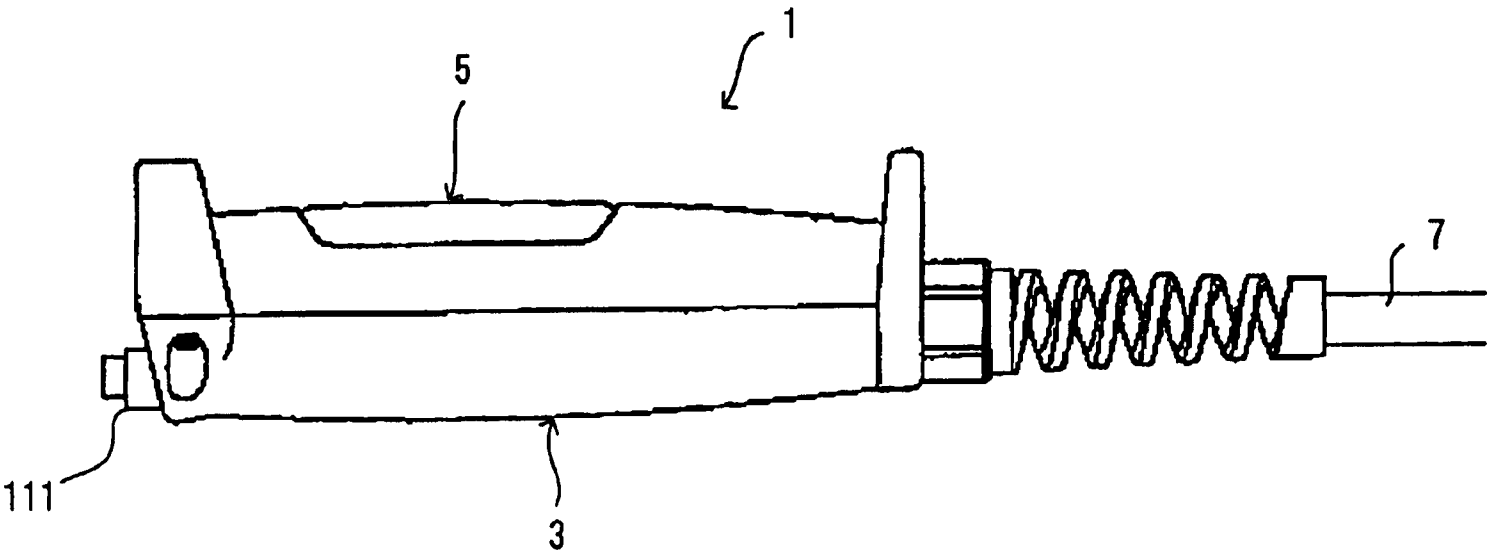
FIG. 9 is a side elevation showing the exemplary modification of the first embodiment hereof.

In the third embodiment described above, the grip type switch device 181 may be provided with the indication means such as the two LEDs for indicating the ON and OFF states of the switch. The switch device may be further provided with the drive switch 111 as shown in FIG. 9 or with the emergency stop switch 113 as shown in FIG. 10.

Needless to say, the push-button switch 131 of the slow action type illustrated in the second embodiment may be used as the push-button switch disposed in the grip type switch device 181.

Although the three-position type push-button switches are employed as the push-button switches disposed in the grip type switch devices of the foregoing embodiments, the present invention is not limited to this. The present invention may employ a two-position type push-button switch which is switched between ON and OFF by push-button depression.

The foregoing embodiments illustrate the examples where the push-button switch includes the two c-contacts or a-contacts. It goes without saying that the push-button switch may include one contact or three or more contacts.

It is noted that the watertight means and the indication means of the present invention are not limited to the watertight packing 17 and the LEDs 37*a*, 37*b* illustrated in the foregoing embodiments. As a matter of course, the configuration of the guard member 27 is not also limited to that illustrated by the above embodiments. In short, the guard member may be so configured as to permit the push-button switch to be manipulated and to cover a part of the push button thereby to prevent the push button from being depressed by the adhesive tape wound therearound.

In an alternative arrangement, a sensor for detecting a human hand gripping the switch case may be provided in place of the guard member 27. The arrangement is made such that the push-button switch can be switched ON or OFF only when the sensor detects the human hand gripping the switch case. In this manner, the grip type switch device is prevented from being used with the adhesive tape wound therearound. As this sensor, an electrostatic condenser type sensor is preferred, which provides an easy and reliable detection of the human hand gripping the switch case based on the variations of capacitance.

It is to be noted that the present invention is not limited to the foregoing embodiments and various changes and modifications may be made thereto within the scope of the invention.

INDUSTRIAL APPLICABILITY

As mentioned supra, the grip type switch device according to the present invention is arranged such that the cable is removably held in electrical connection with the push-button switch by way of the connection means contained in the switch case. In the case of damage on the cable, for example, the cable alone can be removed from the grip type switch device for replacement. In contrast to the prior art, the present invention does not require the whole grip type switch device to be replaced by a new one when the cable is damaged. Furthermore, the present invention does not require an expensive connector such as the watertight connector. Thus, the maintenance cost associated with the cable replacement can be reduced.

In addition, the grip type switch device according to the present invention features the terminal block as the connection means, wherein the conductive connection portions, on the one side, at the terminal block electrically connected with the push-button switch are removably fitted with the conductive connection portions, on the other side, attached to the leading ends of the cores of the cable. Therefore, the cable can be replaced by releasing the cores of the cable from the terminal block. Furthermore, the less costly terminal block provides for the connection between the push-button switch and the cable and hence, a simple connection structure results. Thus, the maintenance cost for the grip type switch device can be reduced.

In addition, the grip type switch device according to the present invention features the connection means which consists of the connector including the connector portion for the switch and the connector portion for the cable. In order to replace the cable, therefore, the fitted connector portions only need be disengaged from each other, so that the cable replacement is facilitated. In addition, the push-button switch and the cable are interconnected by way of the less costly connector, which contributes to the simple configuration. Thus, the maintenance cost for the grip type switch device can be reduced.

In the grip type switch device according to the present invention, the push-button switch thereof is adapted to be shifted from the first OFF state to the ON state and then to the second OFF state according to the increased amounts of push-button depression. Thus, the push-button switch in the ON state can be returned to the first OFF state by releasing the push button, or conversely to the second OFF state by pressing further down on the push button. Thus, the safety of the operator can be enhanced.

The auxiliary contact assuming different open/close positions in the first OFF state and the second OFF state is provided in the switch case. Therefore, whether the push-button switch is in the first OFF state or in the second OFF state can be readily determined by monitoring the open/close position of the auxiliary contact.

The controller for industrial machinery employing the grip type switch device according to the present invention is arranged such that the control panel for industrial machinery is disabled when the push-button switch of the grip type switch device is ON. This prevents the industrial machinery from being inadvertently activated by someone outside the partitioning means that manipulates the control panel when the industrial machinery is subjected to the program teaching via the grip type switch device. Thus, the safety of the operator performing the teaching operation can be ensured.

What is claimed is:

1. A grip type switch device, comprising:

a switch case configured to be held by one hand and including a push-button switch capable of being switched OFF or ON according to the amount of push-button depression, wherein connection means contained in said switch case establishes removable electrical connection between an end of a cable introduced into said switch case and contacts of said push-button switch, and said push-button switch is shifted from a first OFF state to an ON state and then to a second OFF state according to the increased amounts of push-button depression, and wherein said push-button switch includes an auxiliary contact in said switch case, said auxiliary contact designed to be opened or closed when said push-button switch is in said first OFF state and to be closed or opened when said push-button switch is in said second OFF state.

2. A grip type switch device, comprising:

a switch case configured to be held by one hand and including a push-button switch capable of being switched OFF or ON according to the amount of push-button depression, wherein connection means contained in said switch case establishes removable electrical connection between an end of a cable introduced into said switch case and contacts of said push-button switch, said switch case is provided with an emergency stop switch to be manipulated for bringing an external system into emergency stop, and said switch case is provided with an actuator removably inserted in a safety switch provided at said external system, and wherein said external system is shifted to an enable mode for control via a control panel of said external system upon insertion of said actuator in said safety switch, whereas said external system is shifted to a disable mode for control via the control panel thereof upon extraction of said actuator from said safety switch.

3. The grip type switch device as claimed in claim 1, wherein said switch case is provided with an emergency stop switch to be manipulated for bringing an external system into emergency stop.

4. The grip type switch device as claimed in claim 1 or 2, wherein said connection means comprises a base contained in said switch case, and a terminal block formed on said base and including a plurality of conductive connection portions, on one side, electrically connected with the contacts of said push-button switch, and wherein conductive connection portions, on the other side, attached to individual leading ends of plural cores of said cable are removably fitted with the corresponding conductive connection portions on said one side, thereby establishing electrical connection of said cable.

5. The grip type switch device as claimed in claim 1 or 2, wherein said connection means comprises a connector including a connector portion for the switch which is contained in said switch case and electrically connected with the contacts of said push-button switch, and a connector portion for the cable which is electrically connected with leading ends of plural cores of said cable introduced into said switch case and is removably fitted with said connector portion for the switch.

6. The grip type switch device as claimed in claim 1 or 2, wherein a guard member for partially covering a push button of said push-button switch is removably fixed to said switch case.

7. The grip type switch device as claimed in claim 1 or 2, wherein indication means indicative of the ON and OFF states of said push-button switch is provided at said switch case.

8. The grip type switch device as claimed in claim 1 or 2, wherein a drive switch for another device is provided at said switch case.

9. The grip type switch device as claimed in claim 1 or 2, wherein said switch case is provided with watertight means at a lead-in portion thereof, through which said cable is introduced into said switch case.

10. The grip type switch device as claimed in claim 1 or 2, wherein a push button of said push-button switch projects from a periphery of said switch case, and wherein said switch case is formed with projections at places on opposite sides of said push button, said projections projecting further outward than said push button.

11. A controller for industrial machinery employing the grip type switch device as claimed in any one of claims 1 or 2, the controller comprising:

partitioning means partitioning a zone around an industrial machinery and including a doorway freely opened or closed; and a control panel for said industrial machinery disposed near said doorway and switched between a disable mode for control and an enable mode for control in association with the ON state and the OFF state of said push-button switch of said grip type switch device, respectively.

12. The grip type switch device as claimed in claim 2, wherein said actuator is disposed in said switch case in a manner to be freely projected or retracted.

* * * * *